US010065828B2

(12) United States Patent
Takeuchi et al.

(10) Patent No.: US 10,065,828 B2
(45) Date of Patent: Sep. 4, 2018

(54) PAPER OUTPUT TRAY AND IMAGE FORMING APPARATUS

(71) Applicant: CANON KABUSHIKI KAISHA, Tokyo (JP)

(72) Inventors: Masaaki Takeuchi, Tokyo (JP); Akinori Yokota, Tokyo (JP); Yuko Harada, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/652,529

(22) Filed: Jul. 18, 2017

(65) Prior Publication Data

US 2018/0024490 A1 Jan. 25, 2018

(30) Foreign Application Priority Data

Jul. 22, 2016 (JP) ..... 2016-144768

(51) Int. Cl.
*B65H 31/20* (2006.01)
*B65H 31/02* (2006.01)

(52) U.S. Cl.
CPC ..... *B65H 31/20* (2013.01); *B65H 31/02* (2013.01); *B65H 2402/45* (2013.01); *B65H 2405/11164* (2013.01); *B65H 2405/111646* (2013.01)

(58) Field of Classification Search
CPC ..... B65H 1/04; B65H 2405/1116; B65H 2405/11161; B65H 2405/11162; B65H 2405/11164; B65H 2405/111646; B65H 2405/1117; B65H 2402/45; B65H 31/20
See application file for complete search history.

(56) References Cited

U.S. PATENT DOCUMENTS

| | | | | |
|---|---|---|---|---|
| 9,630,788 | B2 * | 4/2017 | Horita | B65H 1/00 |
| 2011/0278789 | A1 * | 11/2011 | Otani | B65H 31/20 271/207 |
| 2016/0107855 | A1 * | 4/2016 | Sato | B65H 7/00 271/3.14 |
| 2016/0124370 | A1 * | 5/2016 | Miwa | G03G 15/6552 399/405 |
| 2016/0363905 | A1 * | 12/2016 | Wakimoto | G03G 21/1633 |

FOREIGN PATENT DOCUMENTS

| | | | |
|---|---|---|---|
| JP | H11-139659 | A | 5/1999 |
| JP | 2005-247486 | A | 9/2005 |
| JP | 2007-328302 | A | 12/2007 |

* cited by examiner

*Primary Examiner* — David H Bollinger
(74) *Attorney, Agent, or Firm* — Fitzpatrick, Cella, Harper & Scinto

(57) ABSTRACT

A paper output tray includes: a tray main body where sheets discharged from an apparatus main body are stacked; a first extension tray which is to be housed in the tray main body on a lower surface side thereof so as to be pullable forward from a front end of the tray main body; and a second extension tray which is rotatably supported by the first extension tray and is expandable from a closed state, in which the second extension tray is folded on the upper surface of the first extension tray, to an open state in which the second extension tray extends forward of the first extension tray. The first extension tray has a support portion extending downward from the upper surface where the sheets are stacked, and the second extension tray is rotatably supported by the support portion.

12 Claims, 15 Drawing Sheets

PAPER OUTPUT TRAY AND IMAGE FORMING APPARATUS

BACKGROUND OF THE INVENTION

Field of the Invention

The present invention relates to a paper output tray for use in a paper output stacking portion of an image forming apparatus such as a color copier or a color printer using an electrophotographic method, and also relates to an image forming apparatus.

Description of the Related Art

A configuration of an image forming apparatus is known in which a paper output tray for discharging and stacking the sheets where images have been recorded in an image forming portion is provided in the upper part of the image forming portion.

A method is also known by which an opening portion is provided in the upper surface of the main body of an image forming apparatus so that a process unit including a photosensitive drum (image forming portion) could be inserted and removed from the upper surface of the main body of the apparatus, and an opening-closing member for opening and closing the opening portion is configured of a paper output tray.

Further, the stacking property of long sheets is often secured by providing a paper output tray with a housing-type extension tray for stacking long sheets. The advantage of the system using the extension tray is that when the sheets to be printed have a standard length or when the image forming apparatus is not used, the extension tray is housed in a tray main body, thereby reducing the space occupied by the image forming apparatus.

Extension trays of a rotation system (Japanese Patent Application Publication No. 2007-328302), a pull-out system (slide system) (Japanese Patent Application Publication No. 2005-247486), and a detachable system (Japanese Patent Application Publication No. H11-139659) are known. A pull-out system is also known in which a second extension tray of a rotation type is further provided at the tip of pulled-out first extension tray. The advantage of such a system combining this pull-out system and the rotation system is that even when the first extension tray is short due to the space limitation in the housing portion, the length such that long sheets can be stacked can be ensured by combining the second extension tray with the first extension tray.

In the case of a paper output tray in which two extension trays of the pull-out system and rotation system are combined, the second extension tray and the first extension tray are together housed inside the tray main body in a state in which the second extension tray of the rotation system is housed on the first extension tray.

However, in some cases, the second extension tray of the rotation system is accidentally housed in a state in which the second extension tray overlaps with the stacking surface of the tray main body, that is, in a state in which only the first extension tray is housed inside the tray main body, whereas the second extension tray appears outside the tray main body.

Where a printing operation is performed and a paper sheet is output in this state, the leading end of the sheet may be caught between the tray main body and the second extension tray, the trailing end of the sheet may not be completely discharged, and a sheet jam may occur. The resulting disadvantage is that the printing operation is interrupted and the user has to resolve the problem of printing interruption and sheet jamming.

SUMMARY OF THE INVENTION

It is an object of the present invention to provide a paper output tray and an image forming apparatus that make it possible to prevent the occurrence of sheet jamming even when the first extension tray of the pull-out system is housed in the tray main body in a state in which the second extension tray of the rotation system accidentally appears outside the tray main body.

In order to achieve the object described above, a paper output tray according to an embodiment of the present invention is a paper output tray holding sheets, which are discharged, the paper output tray comprising:

a tray main body;

a first extension tray which is to be housed on a lower surface side opposite to an upper surface, which is a sheet holding surface of the tray main body, the first extension tray being pullable out from the tray main body in a sheet discharge direction; and a second extension tray which is rotatably supported by the first extension tray and which is rotatable to be in a closed state in which the second extension tray is folded with respect to the first extension tray and an open state in which the second extension tray is open with respect to the first extension tray so that a sheet holding region is wider than that in the closed state, wherein when the second extension tray is in the closed state, the first extension tray can be housed in the tray main body on a lower surface side thereof, and wherein the first extension tray has a support portion extending downward from a virtual surface obtained by extending the upper surface, and the second extension tray is rotatably supported by the support portion.

Further features of the present invention will become apparent from the following description of exemplary embodiments (with reference to the attached drawings).

BRIEF DESCRIPTION OF THE DRAWINGS

FIG. 9A is an exploded side view, FIG. 9B is an exploded perspective view, FIG. 9C is a perspective view of an assembled state with its partially enlarged view;

FIG. 12A is a top view in a closed state, FIG. 12B is a partial sectional view taken along the line C-C in FIG. 12A with its partially enlarged view, FIG. 12C is a top view in an open state, FIG. 12D is a sectional view taken along the line D-D in FIG. 12C with its partially enlarged view;

DESCRIPTION OF THE EMBODIMENTS

Hereinafter, a description will be given, with reference to the drawings, of embodiments of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments are not intended intend to limit the scope of the invention to the following embodiments.

(Overall Configuration of Image Forming Apparatus)

Figure 1:
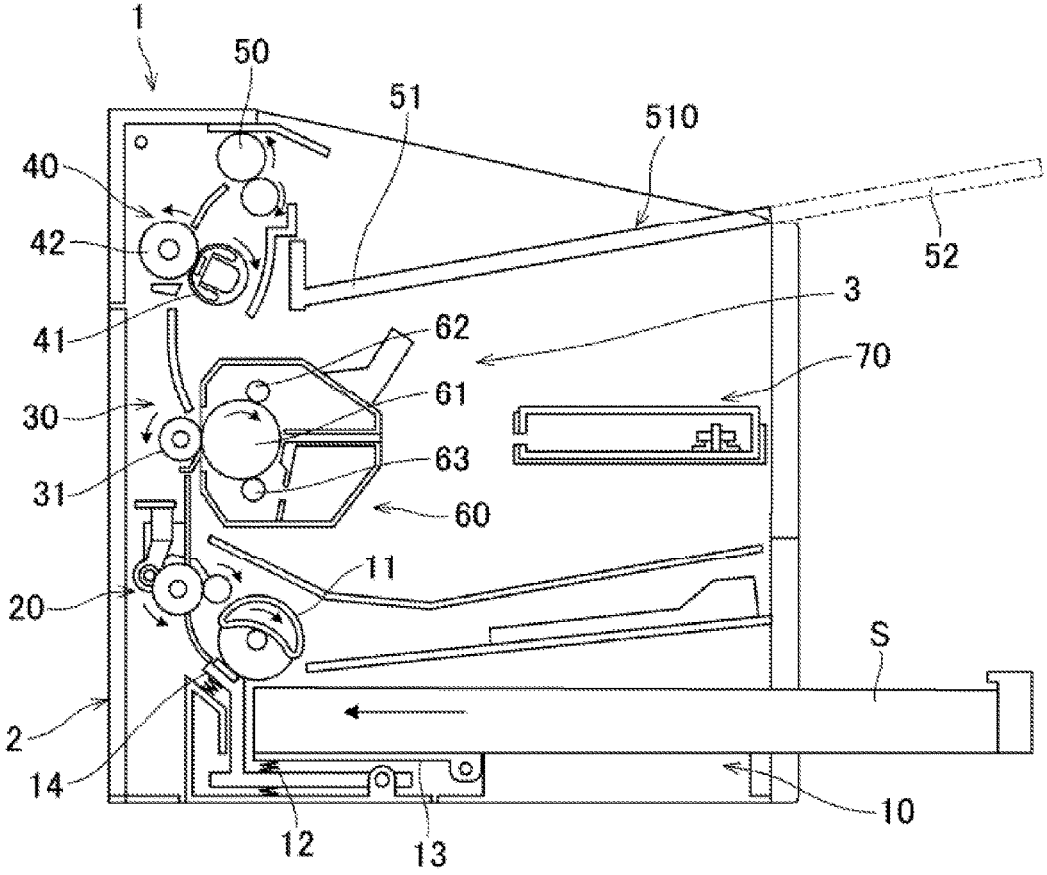
FIG. 1 is a schematic cross-sectional view showing a configuration example of an image forming apparatus.
Figure 2:
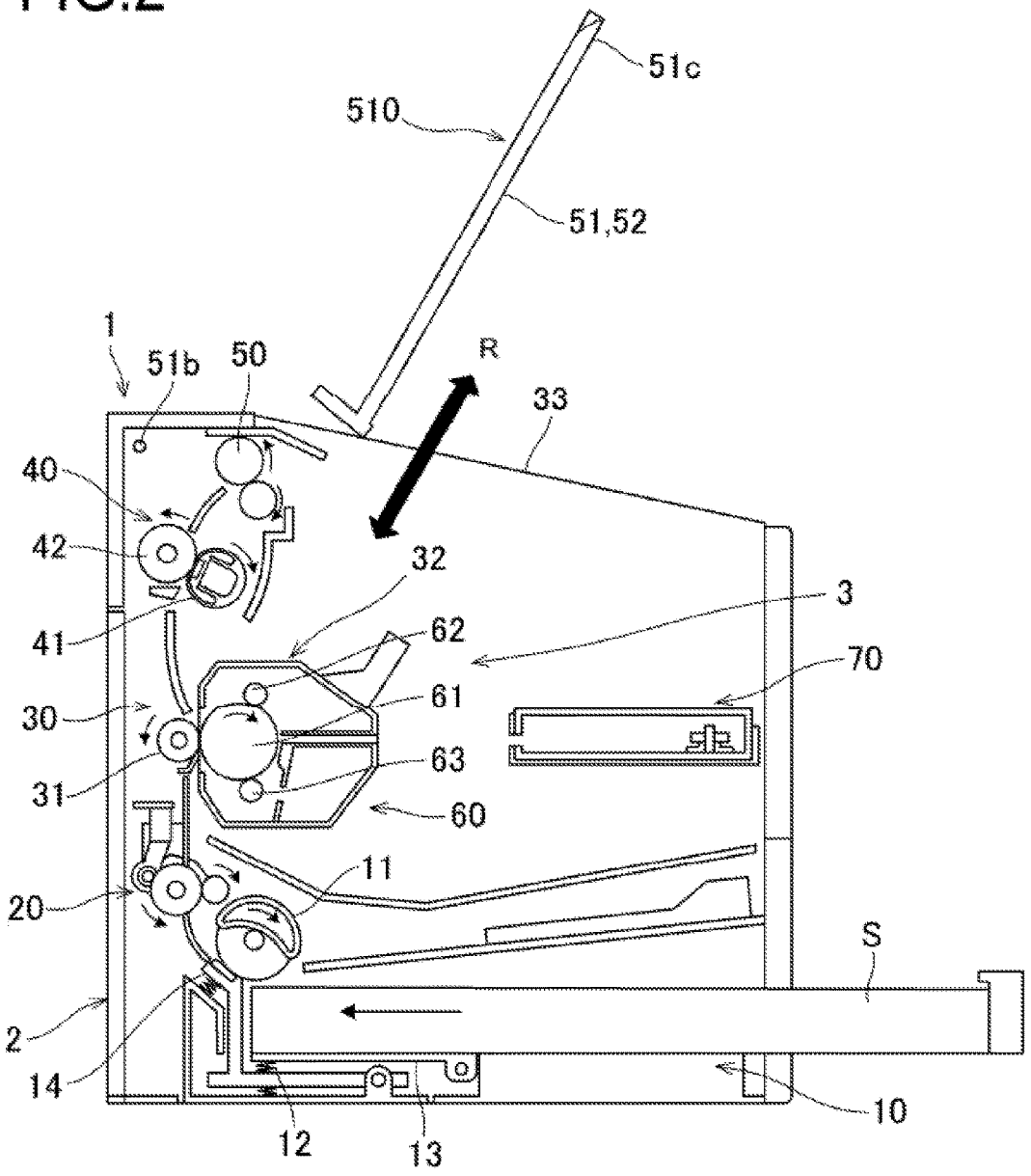
FIG. 2 is a schematic cross-sectional view of the image forming apparatus when the cartridge is inserted/removed.

First, an overview of the overall configuration of the image forming apparatus to which the present invention can be applied will be described with reference to FIGS. 1 and 2. FIG. 1 is a cross-sectional view showing the schematic configuration of the image forming apparatus. FIG. 2 is a cross-sectional view in which a paper output tray 510 is opened from the state shown in FIG. 1 and a process cartridge 60 is in a state where it can be attached and detached.

In FIG. 1, the image forming apparatus 1 is a laser beam printer, and the apparatus main body 2 is provided with an image forming portion 3 for forming an image by an electrophotographic method, and a sheet feeder 10 for feeding a sheet S to the image forming portion 3. Here, the image forming portion 3 includes a photosensitive drum 61 for forming a toner image, a transfer roller 31 for transferring the toner image formed on the photosensitive drum 61 to the sheet S, a charging roller 62 for uniformly charging the surface of the photosensitive drum 61, a developing device 63, and the like.

The photosensitive drum 61, the charging roller 62 that uniformly charges the surface of the photosensitive drum 61, and the developing device 63 are configured as the process cartridge 60, and are also configured to be detachably attachable from above the apparatus main body 2 in the direction of the arrow R in FIG. 2.

Next, the image forming operation of the image forming apparatus 1 configured as described above will be described.

First, based on an image signal from a host computer (not shown in the figure), the photosensitive drum 61 which has been uniformly charged on the surface in advance by the charging roller 62 and rotates clockwise is irradiated with a laser beam from a laser scanner 70 provided on the apparatus main body 2. As a result, an electrostatic latent image is formed on the surface of the photosensitive drum 61. Next, the electrostatic latent image on the surface of the photosensitive drum 61 is developed by the toner carried on the developing device 63, and a toner image is formed on the photosensitive drum 61.

Meanwhile, a sheet feeding roller 11 starts to rotate at a predetermined timing, and in conjunction with this, an inner plate 13 rotates upward. The inner plate 13 is biased toward the sheet feeding roller 11 by the force of a coil spring 12. As a result, the leading end portion of the sheet S, stacked on the inner plate 13 is brought into pressure contact with the sheet feeding roller 11 with a predetermined force. Here, the sheet feeding roller 11 is controlled to rotate clockwise only at the time of paper feed, and the sheet S which has been brought into pressure contact therewith is fed by a frictional force. When a plurality of sheets S on the inner plate 13 is to be sent out at the same time, only the uppermost sheet S is separated by the action of a separation means 14 and conveyed downstream. The uppermost sheet S thus separated by the separation means 14 is sent to a registration unit 20 and corrected for skew. The sheet is then conveyed by the registration unit 20 to a transfer portion 30 configured of the photosensitive drum 61 and the transfer roller 31.

In the transfer portion 30, as described above, the toner image formed on the photosensitive drum 61 is electrically attracted by the transfer roller 31 and transferred to the sheet S. The sheet S to which the toner image has been transferred is then conveyed by the transfer portion 30 to a fixing unit 40 including a heating unit 41 and a pressurizing roller 42, and heated and pressurized in the fixing unit 40 to fix the toner image. Thereafter, the sheets are successively discharged onto the paper output tray 510 on the upper surface of the apparatus main body 2 by a paper output roller pair 50. In the paper output tray 510, an extension tray 52 is retractably housed in a tray main body 51. The detailed configuration of the paper output tray will be described hereinbelow.

Next, the opening-closing operation of the paper output tray 510 in the present invention will be described with reference to FIG. 2. As shown in FIG. 2, the paper output tray 510 is provided to be rotatable with respect to the upper portion of the apparatus main body 2 and is configured to open and close an opening portion 33 provided in the upper portion of the apparatus main body 2. When the process cartridge 60 is inserted into and removed from the apparatus main body 2, first, the paper output tray 510 is lifted to open the opening portion 33. The rotation of the paper output tray 510 lifts an end portion 51*c* of the paper output tray, which is on an opposite end of a tray rotary shaft 51*b*. As a result, it is possible to open the opening portion 33, which is a passage to a cartridge mounting portion 32 for mounting the process cartridge 60. The user can insert and remove the process cartridge 60 only when the opening portion 33 is in the open state. Once the mounting of the process cartridge 60 has been completed, the paper output tray 510 is relatively rotated substantially downward with respect to the apparatus main body 2 by pushing down the end portion 51*c* of the paper output tray. As a result, the opening portion 33 is closed, and a bundle of the printed sheets S can be stacked on the paper output tray 510.

When the image forming apparatus 1 is in operation, the photosensitive drum 61, the charging roller 62 that uniformly charges the surface of the photosensitive drum 61, the developing device 63, etc. which are constituent members of the process cartridge 60 are rotated, and therefore the user needs to be prevented from touching these components. For this purpose, a detection means (not shown in the figure) is provided for detecting whether the paper output tray 510 is pushed down and the opening portion 33 is in a completely closed state. Where the opening portion 33 is determined to be in the completely closed state on the basis of the detection result of the detection means, a control unit (not shown in the figure) enables the execution of the printing operation of the apparatus main body 2. Conversely, where the detection result of the detection means indicates that the opening portion 33 is not in the completely closed state, the control unit (not shown in the figure) stops the printing operation or does not start a new operation.

(Paper Output Tray)

Next, the paper output tray 510 in the present invention will be described in detail with reference to FIGS. 3 to 8.

First, the open/closed states of the extension tray 52 and the extension stopper 53 will be described with reference to FIG. 3.

Figure 3A:
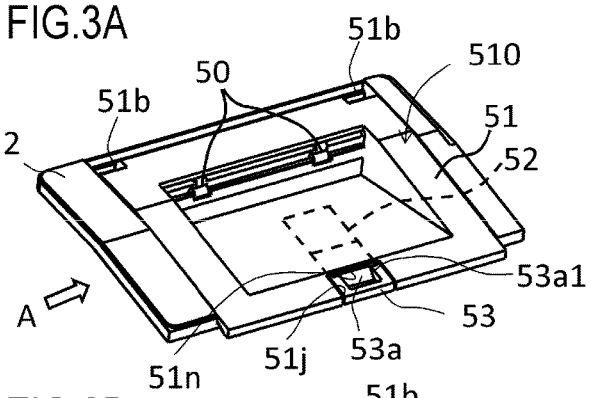
FIGS. 3A to 3C are perspective views of the entire paper output tray.
Figure 3D:
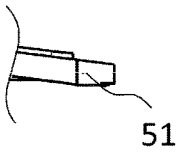
FIGS. 3D-3F are partial views as seen from a direction arrow A.
Figure 3B:
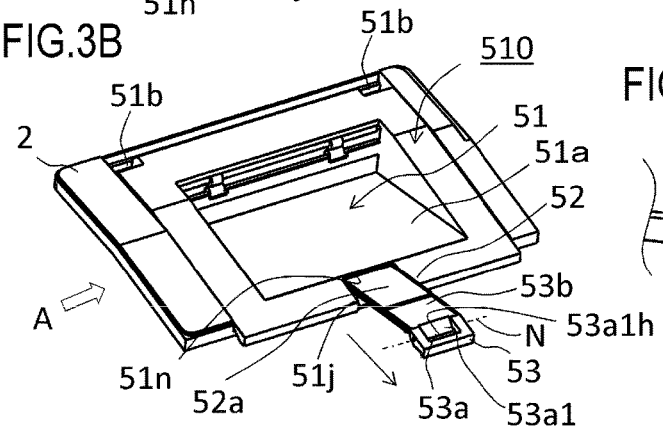
Figure 3E:
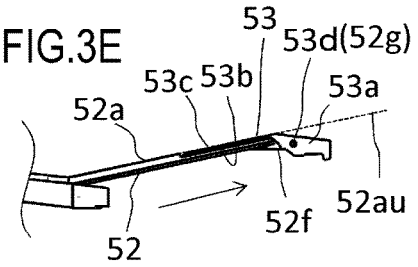
Figure 3C:
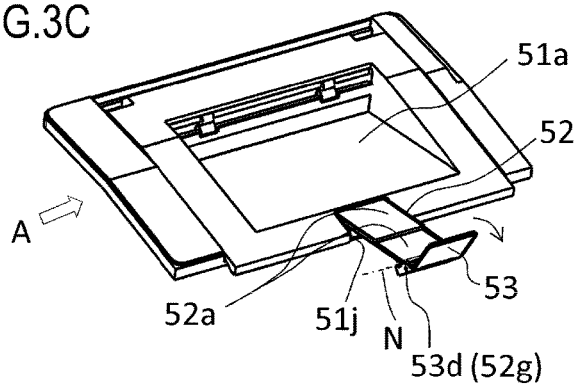
Figure 3F:
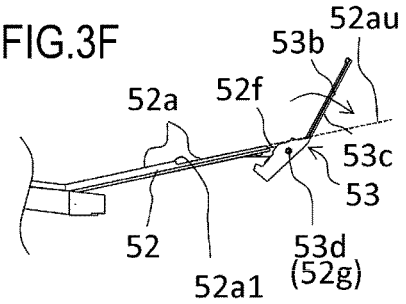

FIGS. 3A to 3F show the paper output tray 510. FIG. 3A is a perspective view taken in a housing state in which the extension tray 52 is housed in the tray main body 51. FIG. 3B is a perspective view taken in a state in which the extension tray 52 is pulled out. FIG. 3C is a perspective view taken in a state in which the extension stopper 53 is open. Further, FIG. 3D is a partial view of the distal end portion in FIG. 3A as viewed from the direction of arrow A. FIG. 3E is a partial view of the distal end portion in FIG. 3B as viewed from the direction of arrow A. FIG. 3F is a partial view of the distal end portion in FIG. 3C as viewed from the direction of arrow A.

As shown in FIG. 3A, the paper output tray 510 includes a tray main body 51, the extension tray 52 (first extension tray) which is housed to be retractable in the sheet discharge direction with respect to the front end portion of the tray main body 51, and the extension stopper 53 (second extension tray) provided to be rotatable with respect to the extension tray 52. The extension tray 52 is disposed on the lower surface side of the tray main body 51 (the side opposite to the surface where the sheet is held) and is housed to be retractable forward from the front end of the tray main body 51 (FIG. 3B). Further, the extension stopper 53 is rotatably supported on the extension tray 52, and is configured to be expandable from a closed state in which it is folded on the upper surface of the extension tray 52 to an open state in which it extends forward of the extension tray 52 (FIG. 3C). The state in which the extension stopper 53 is closed and the extension tray 52 and the extension stopper 53 are housed in the tray main body 51 on the lower surface side thereof is a regular housing state (FIG. 3A).

The tray main body 51 is attached to the apparatus main body 2 so as to be freely opened and closed in the vertical direction around a tray rotary shaft 51*b* disposed on the upstream side in the discharge direction of the sheet S. A sheet stacking surface 51*a* on which sheets S discharged by the paper output roller pair 50 of the apparatus main body 2 are stacked is provided on the upper surface of the tray main body. The sheet stacking surface 51*a* is a slanted surface that is slanted so that the downstream end thereof in the sheet discharge direction is higher than the upstream end.

The extension tray 52 is a rectangular member extending in the discharge direction of the sheet S. The width dimension orthogonal to the discharge direction is less than that of the tray main body 51, and the sheet stacking surface 52*a* on the upper surface thereof partially supports the region of the widthwise central portion of the sheet S. The extension tray 52 is housed in the lower surface side of the tray main body 51, that is, on the side opposite to the sheet stacking surface 51*a*, from an insertion port 51*n* provided in the upper surface of the front end portion of the tray main body 51.

Further, the extension tray 52 has support arms 52*f* as support portions extending downward from a virtual surface (a surface indicated by a broken line) 52*au* obtained by extending the sheet stacking surface 52*a* which is the upper surface on which the sheets S are stacked (FIG. 3E). The extension stopper 53 is rotatably supported on the support arms 52*f*. In this example, a rotation shaft 52*g* provided on the support arms 52*f* is rotatably fitted in rotation center holes 53*d* provided in the extension stopper 53, and the extension stopper 53 is free to rotate about a rotation center line N orthogonal to the discharge direction of the sheet S.

The extension stopper 53 has a handle 53*a* extending forward of the rotation center line N in a closed state in which the extension stopper is folded on the upper surface of the extension tray 52. In a state where the extension tray 52 is housed in the tray main body 51, the handle 53*a* is fitted into a recess 51*j* formed in the upper surface of the front end portion of the tray main body 51. In addition, the handle 53*a* is provided with a finger placement recess 53*a*1 for placing a finger.

When the extension tray 52 is not in use, as shown in FIGS. 3A and 3D, the extension tray 52 and the extension stopper 53 are housed inside the tray main body 51. The extension stopper 53 is housed together with the extension tray 52 on the lower surface side (rear surface side) of the sheet stacking surface 51*a* of the tray main body 51 in a state of being folded on the upper surface of the extension tray 52. When the extension tray and the extension stopper are thus housed, the volume occupied by the image forming apparatus can be reduced in the case of a standard sheet length or when the image forming apparatus is not used.

When the extension tray 52 is used, as shown in FIGS. 3B and 3E, the user puts a finger on the handle 53*a* of the extension stopper 53 and pulls the extension tray 52 out in the direction of the arrow. By pulling out the extension tray 52, the sheet stacking surface 52*a* of the extension tray 52 is added to the sheet stacking surface 51*a* of the tray main body 51, whereby the stacking surface is extended. Since the extension stopper 53 is inverted and overlapped with the sheet stacking surface 52*a* of the extension tray 52, the rear surface 53*c* of the extension stopper 53 functions as a part of the sheet stacking surface 52*a*. In the example shown in the figure, a step 52*a*1 which is lower by the thickness of the extension stopper 53 is provided on the sheet stacking surface 52*a* of the extension tray 52 (FIG. 3F).

The stacking surface is thus extended by the amount corresponding to the sheet stacking surface 52*a* (including the rear surface 53*c* of the extension stopper 53) of the extension tray 52 with respect to the tray main body 51, and the stackability of long sheets S can be ensured.

When the extension stopper 53 is used, as shown in FIGS. 3C and 3F, the user places a finger on the handle 53*a* and rotates the extension stopper 53 in the direction of the arrow to bring the extension stopper into the open state. At this time, the portion 53*a*1*h* (wall on the downstream side in the sheet discharge direction among the walls forming the finger placement recess 53*a*1) of the handle 53*a* on which the user places the finger is located forward (downstream in the sheet discharge direction) of the rotation center line N. Therefore, the user can easily perform the operation of opening the extension stopper 53 at the same time as the extension tray 52 is pulled out. As a result of opening the extension stopper 53 forward, a sheet stacking surface 53*b* of the extension stopper 53 is added to the front side with respect to the front end of the extension tray 52. By extending the sheet stacking surface 53*b*, it is possible to ensure the stackability of sheets which are longer than the sheets that can be adopted in the state shown in FIG. 3B.

In the present embodiment, the configuration is used in which the extension tray 52 is pulled out obliquely upward from the housing state, but a configuration in which the extension tray 52 is pulled out horizontally may also be used. Further, the configuration is used in which the user pulls out the extension tray 52 by placing a finger on the recessed handle 53*a*, but the handle 53*a* may have a protruding configuration of a convex shape.

Further, the configuration is used in which the rotation center holes 53*d* of the extension stopper 53 are located behind the handle 53*a* (on the upstream side in the sheet discharge direction), but the configuration in which the rotation center holes 53*d* are located forward and downward of the handle 53*a*, and the handle 53*a* has a depth sufficient to insert a finger may also be used. In this case, it is desirable that the angle formed by the line connecting the rotation center with the force point of the force by which the finger pulls the handle 53*a* forward and the vector direction of the pulling force be substantially vertical. Since the angle is substantially vertical, it is easy to open the extension stopper 53 at the same time as the user pulls out the extension tray 52.

[Support Structure of Extension Tray 52]

Next, the support structure for supporting the extension tray 52 on the tray main body 51 will be described with reference to FIGS. 4 and 5.

Figure 4A:
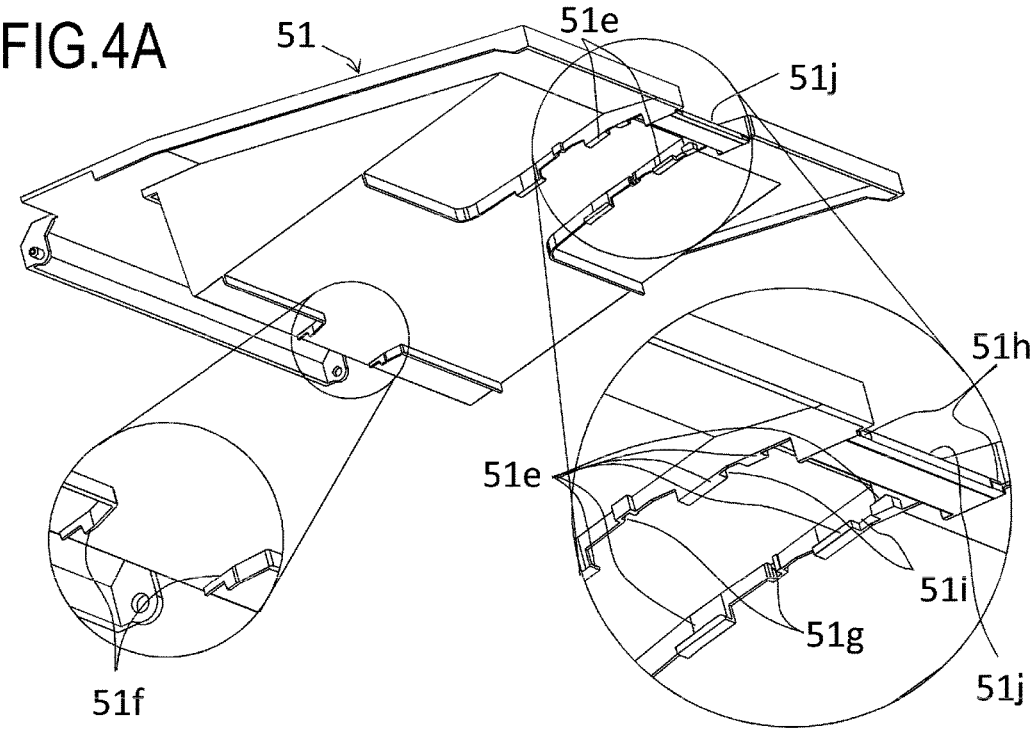
FIG. 4A is a schematic perspective view of the tray main body taken obliquely from below with its partially enlarged views.
Figure 4B:
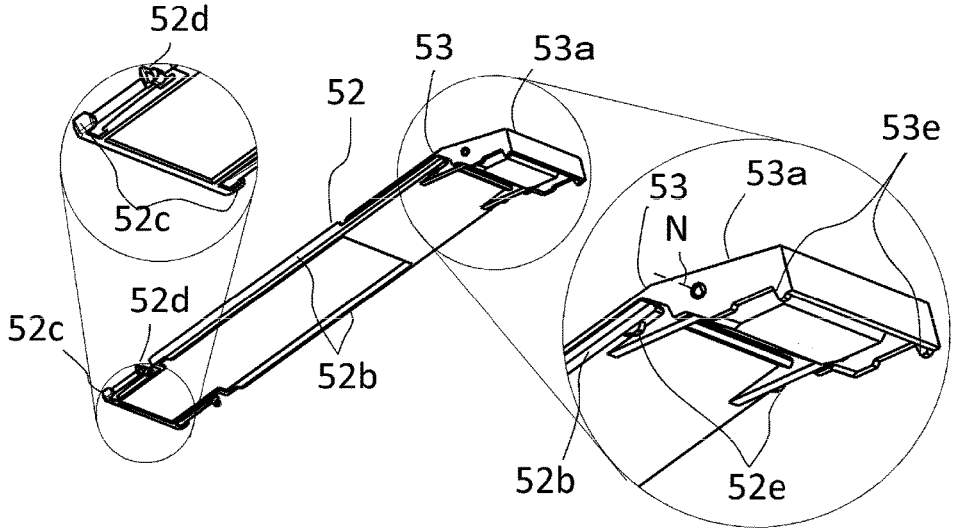
FIG. 4B is a schematic perspective view of the extension tray taken obliquely from below with its partially enlarged views.
Figure 5A:
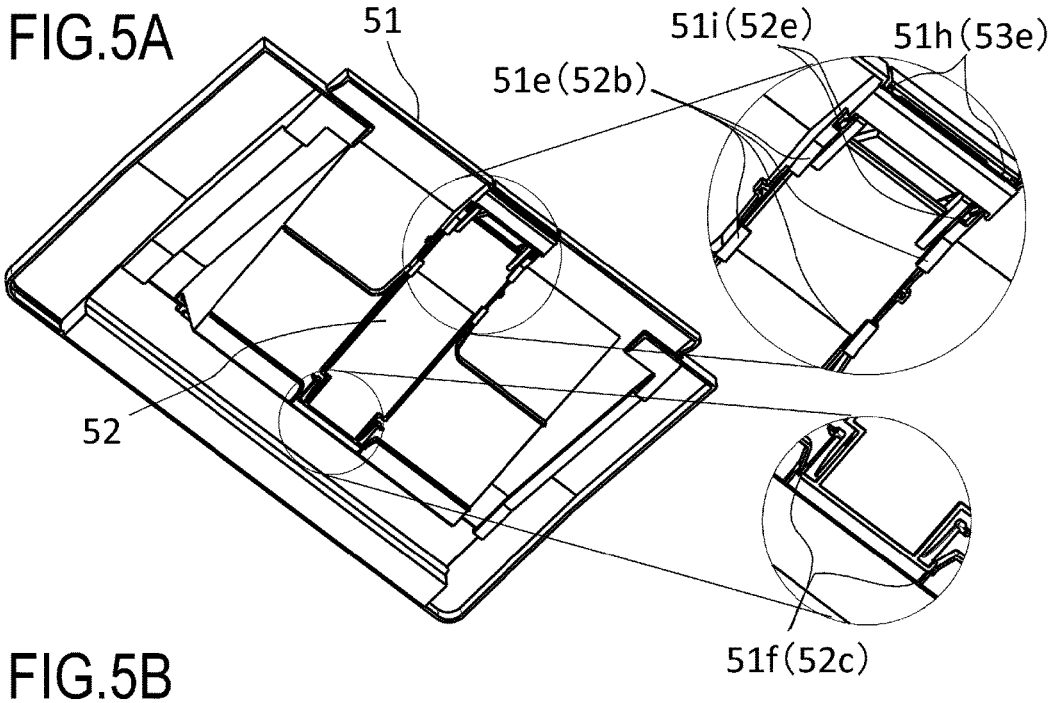
FIGS. 5A and 5B are schematic perspective views of the extension tray in an open and closed states which are taken obliquely from below with their partially enlarged views.
Figure 5B:
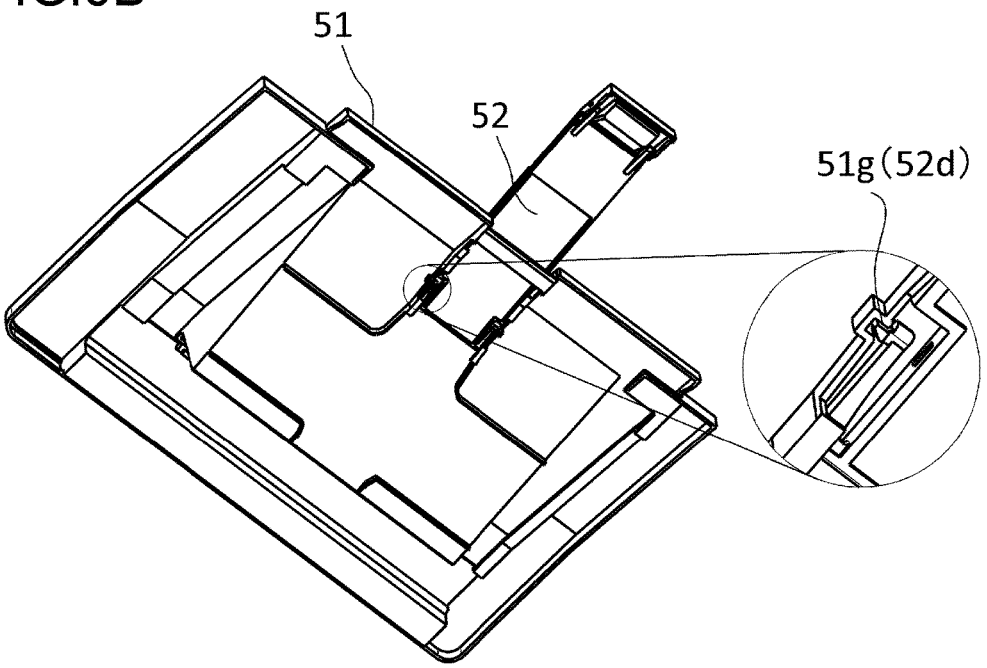

FIG. 4A is a view of the tray main body 51 taken obliquely from below with its partially enlarged views, and FIG. 4B is a view of the extension tray 52 and the extension stopper 53 taken obliquely from below with its partially enlarged views. FIG. 5A is a perspective view (taken from below) of the paper output tray in a state in which the extension tray 52 is housed in the tray main body 51 with its partially enlarged views, and FIG. 5B is a perspective view of the paper output tray in a state in which the extension tray 52 is pulled out of the tray main body 51 with its partially enlarged view. In FIGS. 4 and 5, parts below the tray main body 51 are omitted.

As shown in FIG. 4, a pair of tray guides 51*e* is provided as guide portions for guiding the extension tray 52 on the lower surface of the tray main body 51. The tray guides 51*e* are of a rail shape having an L-shaped cross section and projecting from the lower surface of the tray main body 51. The tray guides extend parallel to each other in the discharge direction of the sheet S at an interval matching the width of the extension tray 52.

Meanwhile, the extension tray 52 is provided with a side surface portion 52*b*, and the extension tray 52 is slidably supported by engaging this side surface portion 52*b* with the tray guide 51*e*, as shown in FIG. 4. Thus, the side surface portion 52*b* is guided in a state of being sandwiched between the lower surface of the tray main body 51 and the tray guide 51*e*.

In the illustrated example, the entire length of the extension tray 52 is substantially equal to the length of the tray main body 51 in the discharge direction of the sheet S, but the length of the tray guide 51*e* is less than the length of the tray main body 51, and in the illustrated example, the tray guide 51*e* extends rearward from the front end position of the tray main body 51 to the intermediate position of the tray main body 51.

Further, as shown in FIG. 4A, on the rear end portion of the lower surface of the tray main body 51, a pair of rear end guides 51*f* is provided through a predetermined length on an extension line of the tray guide 51*e*. Meanwhile, on the rear end portion of the extension tray 52, a rear end side surface portion 52*c* is provided on the extension line of the side surface portion.

When the extension tray 52 is housed, the extension tray 52 is supported on the apparatus main body 2, as shown in FIG. 5A, by the engagement of the rear end side surface portion 52*c* of the extension tray 52 and the rear end guide 51*f* of the tray main body 51.

Further, close to the front end portion of the side surface portion 52*b* of the extension tray 52, an engaging convex portion and an engaging concave portion which engage with each other at the regular housing position of the extension tray 52 are provided, as shown in FIG. 4B, respectively at the side surface portions 52*b* of the extension tray 52 and at the sliding surface of the tray guide 51*e* of the tray main body 51. Thus, a protruding portion 52*e* is provided as the engaging convex portion on each side surface portion 52*b* of the extension tray 52, and hole portions 51*i* configured of a cutout are provided as engaging concave portions in the tray guide 51*e*.

Next, the support of the extension tray 52 in the pull-out direction will be described.

A front end receiving portion 51*h* is provided at the front end portion of the recess 51*j* located at the front end portion of the tray main body 51, as shown in FIG. 4A. Meanwhile, a front receiving portion 53*e* protruding so as to face the front end receiving portion 51*h* provided at the tray main body is provided, as shown in FIG. 4B, at the front end of the extension stopper 53 in a closed state with respect to the extension tray. The front end receiving portion 51*h* is provided at the front end of the recess 51*j*, and the front receiving portion 53*e* is provided on the handle 53*a* fitted in the recess 51*j*.

When the extension tray 52 is housed, as shown in FIG. 5A, the front end receiving portion 51*h* of the tray main body 51 and the front receiving portion 53*e* of the extension stopper 53 abut against each other, thereby establishing the housing position of the extension tray 52.

Further, at the rear end portion of the extension tray 52, a pair of snap fits 52*d* projecting to the left and right is provided, as shown in FIG. 4B, at a position ahead, by a predetermined distance, of the rear end side surface portion 52*c*. Where the snap fit 52*d* is engaged with the tray guide 51*e*, the snap fit is pushed by the tray guide 51*e* and elastically deformed. The tray guide 51*e* is provided with a claw receiving portion 51*g* to which the snap fit 52*d* is engaged at a position where the extension tray 52 is completely pulled out.

Therefore, when the extension tray 52 is pulled out, the snap fit 52*d* of the extension tray 52 and the claw receiving portion 51*g* of the tray main body 51 are engaged with each other, as shown in FIG. 5B, whereby the pull-out position of the extension tray 52 is determined.

In the process of pulling out the extension tray 52, until the extension tray 52 is completely pulled out, the snap fit 52*d* slides against the side surface of the tray guide 51*e* and is bent, which requires a stronger force to pull out the extension tray 52. Once, the extension tray is completely pulled out, a transition is made from the bent state of the snap fit 52*d* to a state in which the snap fit does not receive the load, so that the pull-out force of the extension tray 52 is reduced. By the change in the pull-out force, the user can recognize that the extension tray 52 is completely pulled out.

Further, in this embodiment, the snap fit 52*d* is used as a structure for determining the pull-out position of the extension tray 52, but it is also possible to use a configuration in which a protrusion is provided on the extension tray 52, and the extension tray 52 is bent as a whole to be introduced and held in the receiving portion. Also, a configuration in which the front receiving portion 53*e* of the extension stopper 53 is abutted against the front end receiving portion 51*h* of the tray main body 51 is used to hold the housing direction in the housing state of the extension tray, but the extension tray 52 and the tray main body 51 may also be configured to abut against each other.

(Positioning of Housing Position of Extension Tray 52)

Next, the positioning mechanism of the housing position of the extension tray will be described.

Figure 6A:
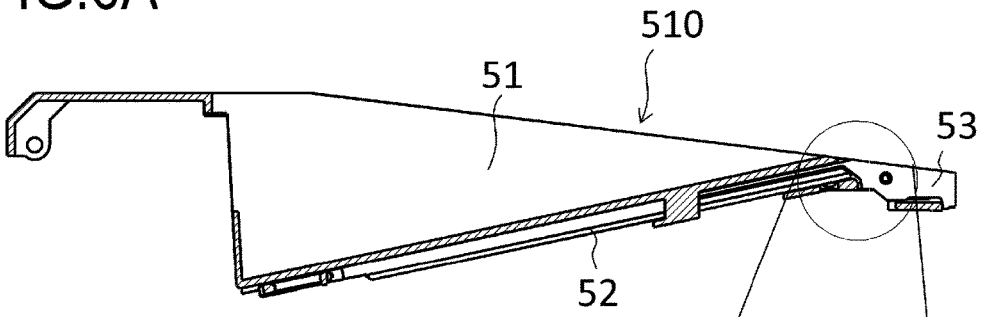
FIG. 6A is an enlarged sectional view taken along the line B-B in FIG. 6B with its partially enlarged view.
Figure 6B:
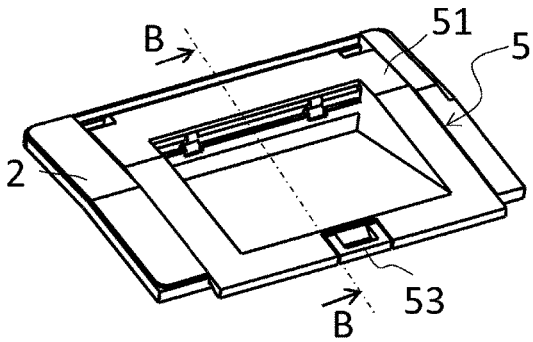
FIG. 6B is a perspective view of the paper output tray.
Figure 6B:
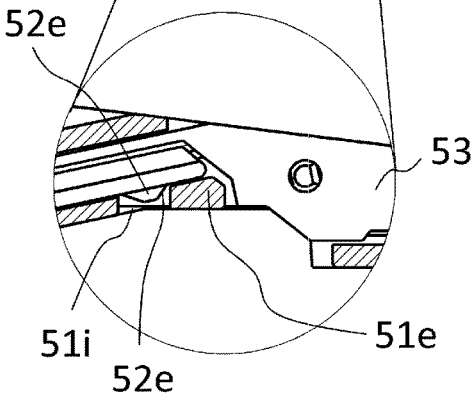
Figure 6C:
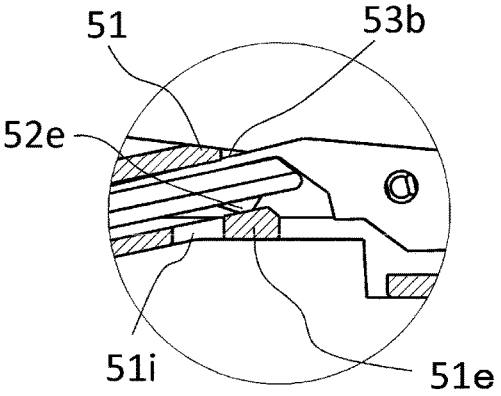
FIGS. 6C and 6D are explanatory views illustrating the operation of the extension tray in the closed state and the open state.
Figure 6D:
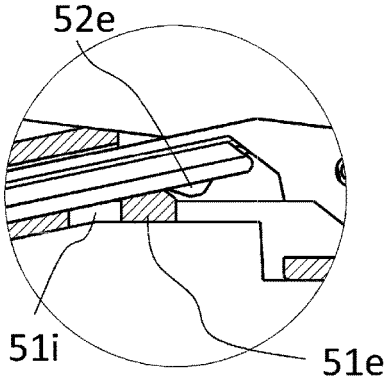

FIG. 6A is a cross-sectional view of the tray main body shown in FIG. 6B with its partially enlarged view, this view being taken along the line B-B, and FIG. 6B is a perspective view of the apparatus main body 2 which is taken obliquely from below. FIGS. 6C and 6D are enlarged views of the front portion shown in FIG. 6A, these views illustrating the operation when pulling the extension tray 52 out from the housing state.

When the extension tray 52 is pulled out from the housing state or when it is housed from the open state, the protruding portion 52*e* of the extension tray 52 rides up on the tray guide 51*e*. When the protruding portion 52*e* rides up, as shown in FIG. 6C, the extension stopper 53 in the closed state comes into contact with the tray main body 51 and becomes deflected, and the closing force of the extension tray 52 becomes stronger. When a transition is made from the state shown in FIG. 6C to the state in which the extension tray 52 is completely housed, as shown in FIG. 6A, the protruding portion 52*e* engages with the hole portion 51*i*, so that the closing force of the extension tray 52 is reduced. By this change in the closing force, the user can recognize that the extension tray 52 has been completely housed.

(Light Shielding Sheet)

Next, a light shielding sheet 54 will be described with reference to FIGS. 7 and 8.

Figure 7A:
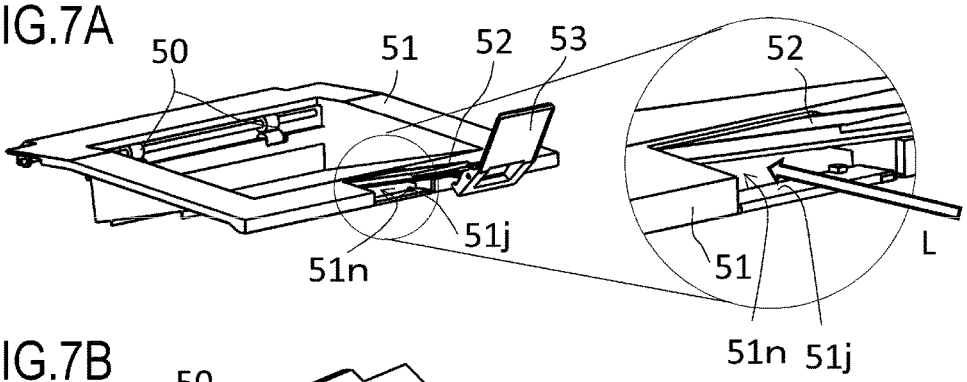
FIG. 7A is a perspective view of the paper output tray with its partially enlarged view.
Figure 7B:
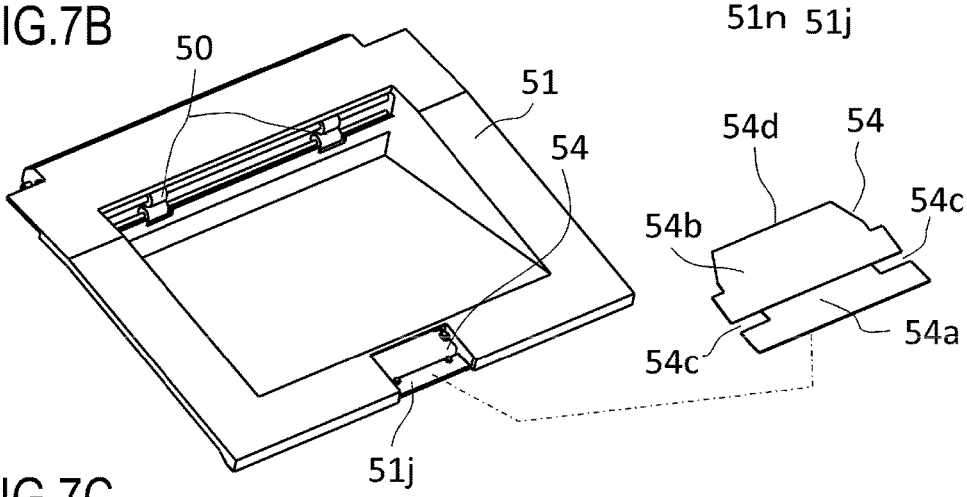
FIG. 7B is a perspective view of the tray main body with a perspective view of the light shielding sheet.
Figure 7C:
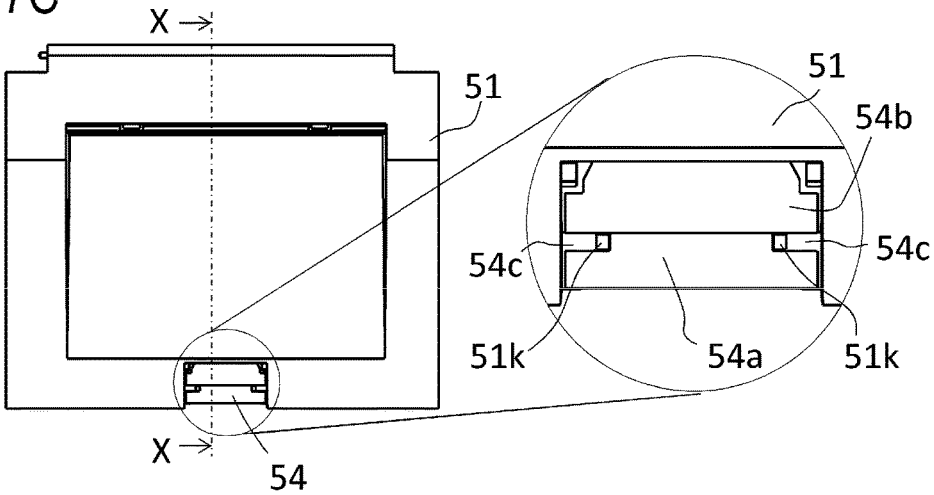
FIG. 7C is a top view of the tray main body to which a light shielding sheet has been attached with its partially enlarged view.

FIG. 7A is a perspective view of an external light penetration state of the paper output tray with its partially enlarged view, FIG. 7B is a perspective view of the tray main body with a perspective view of the light shielding sheet, FIG. 7C is a top view of the tray main body to which the light shielding sheet is attached with its partially enlarged view.

Figure 8A:
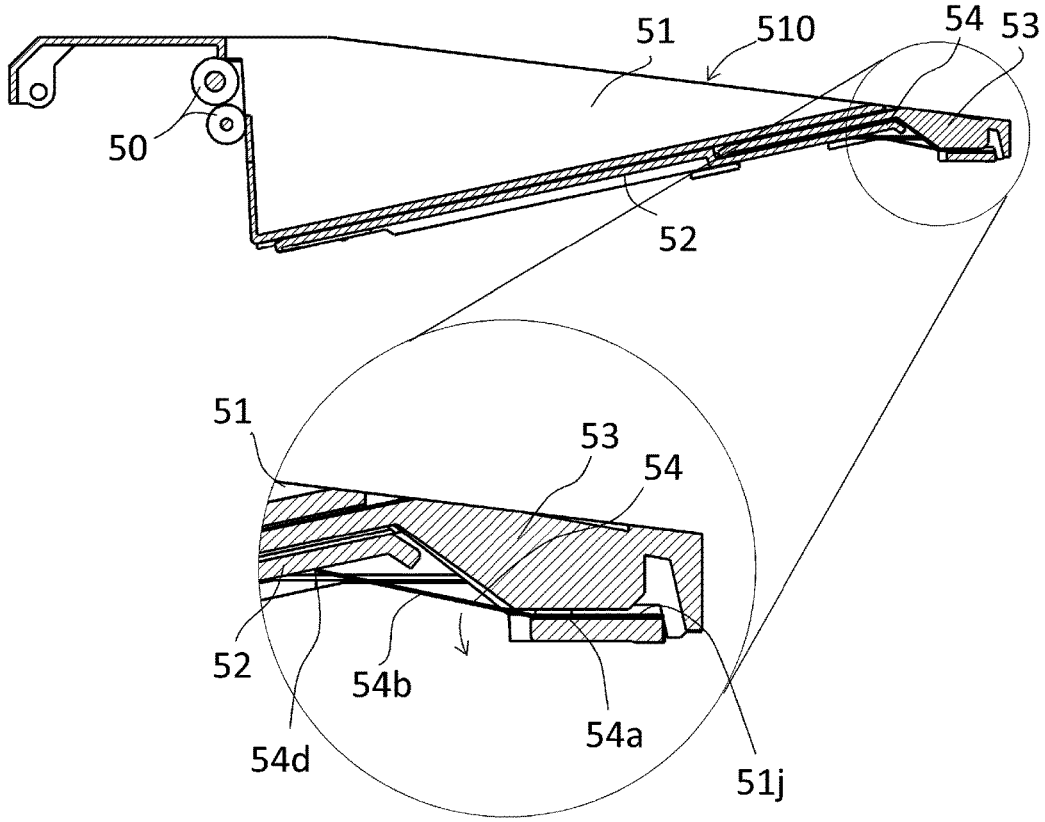
FIG. 8A is a cross-sectional view of the paper output tray with its partially enlarged view explaining the operation of the light shielding sheet.
Figure 8B:
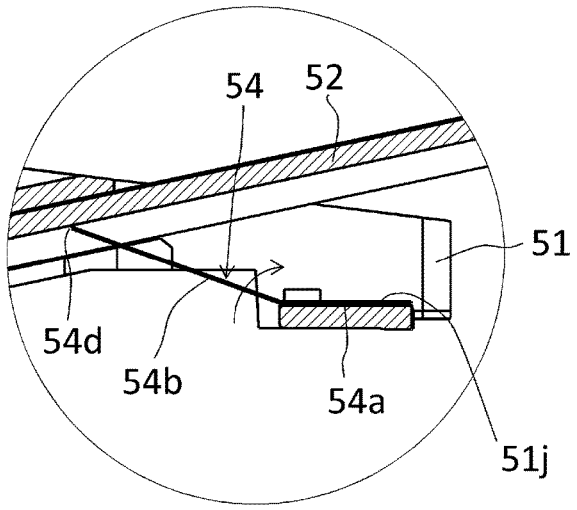
FIG. 8B is an explanatory view of the operation of the light shielding sheet.

FIG. 8A is an enlarged sectional view taken along the line X-X in FIG. 7C in a state where the extension tray 52 is housed with its enlarged view of the distal end portion and FIG. 8B is an enlarged view of the distal end portion in FIG. 8A in a state where the extension tray 52 is pulled out.

As shown in FIG. 7A, the tray main body 51 is provided with an insertion port 51*n* for housing the extension tray 52. In the state in which the extension tray 52 is pulled out, a gap through which the external light enters the interior of the apparatus main body is formed at the insertion port 51*n* of the tray main body 51 between the extension tray 52 and the recess 51*j* positioned at the edge of the insertion port 51*n*. Where an incident light L from the outside enters the interior of the apparatus main body 2 through this gap, the photosensitive drum 61 can be irradiated by the incident light L, thereby making it impossible to form the desired image. Accordingly, as shown in FIG. 7B, a light shielding sheet 54 for shielding the gap between the extension tray 52 and the recess 51*j* is provided to prevent the incident light L from entering the interior of the apparatus main body.

The light shielding sheet 54 is an approximately quadrangular sheet member having elasticity and includes a sheet fixing portion 54*a* fixed to the recess 51*j* of the tray main body 51 which faces the insertion port 51*n*, and a sheet movable portion 54*b* extending rearward from the sheet fixing portion 54*a* toward the inside of the insertion port 51*n*. An adhesive layer (not shown in the figure) is provided on the lower surface of the sheet fixing portion 54*a* and is bonded to the recess 51*j* of the tray main body 51. Further, in the sheet fixing portion 54*a*, as shown in FIG. 7C, positioning of the light shielding sheet 54 with respect to the tray main body 51 is performed by inserting sheet groove portions 54*c* provided on both side edges of the light shielding sheet 54 onto two front protruding portions 51*k* provided in the recess 51*j*.

In a state in which the extension tray 52 is housed, as shown in FIG. 8A, the sheet distal end portion 54*d* is abutted against the lower surface of the extension tray 52. As a result, the sheet movable portion 54*b* of the light shielding sheet 54 is pushed down and the contact state thereof with the lower surface of the extension tray 52 is maintained by a predetermined contact pressure created by an elastic recovery force.

In a state in which the extension tray 52 is pulled out, as shown in FIG. 8B, the elastic force maintains the abutment of the sheet distal end portion 54*d* against the extension tray 52, and the sheet movable portion 54*b* of the light shielding sheet 54 moves in the direction of the arrow.

As described above, since the sheet movable portion 54*b* is an elastic member, the light shielding sheet 54 is retracted so as not to interfere with the extension tray 52 or the extension stopper 53 when the extension tray 52 is housed (FIG. 8A). Further, when the extension tray 52 is pulled out, the sheet distal end portion 54*d* abuts against the extension tray 52, thereby preventing the incident light L from entering the interior of the apparatus main body from the gap between the insertion port 51*n* of the tray main body 51 and the extension tray 52. Another effect is that since the light shielding sheet 54 closes the gap between the insertion port 51*n* of the tray main body 51 and the extension tray 52, foreign matter is prevented from entering the interior of the apparatus main body 2.

(Configuration of Extension Tray 52 and Extension Stopper 53)

Next, the configuration and engagement state of the extension tray 52 and the extension stopper 53 will be described in detail with reference to FIGS. 9 to 12.

First, the engagement state of the extension tray 52 and the extension stopper 53 will be described with reference to FIGS. 9A to 9C.

Figure 9A:
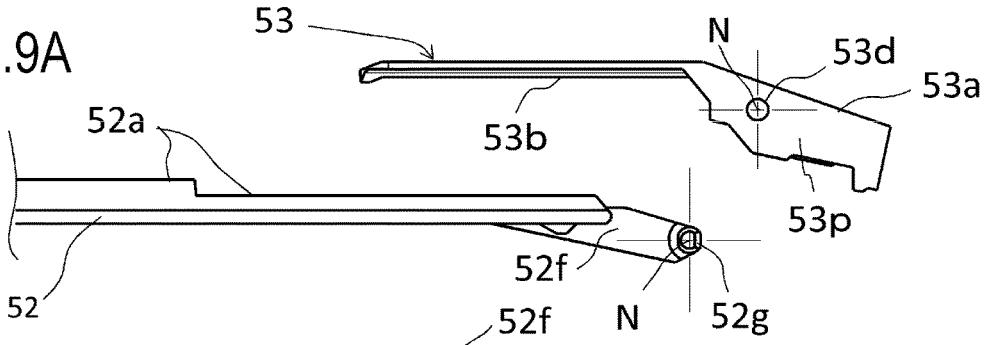
FIGS. 9A to 9C show an extension tray and an extension stopper.
Figure 9B:
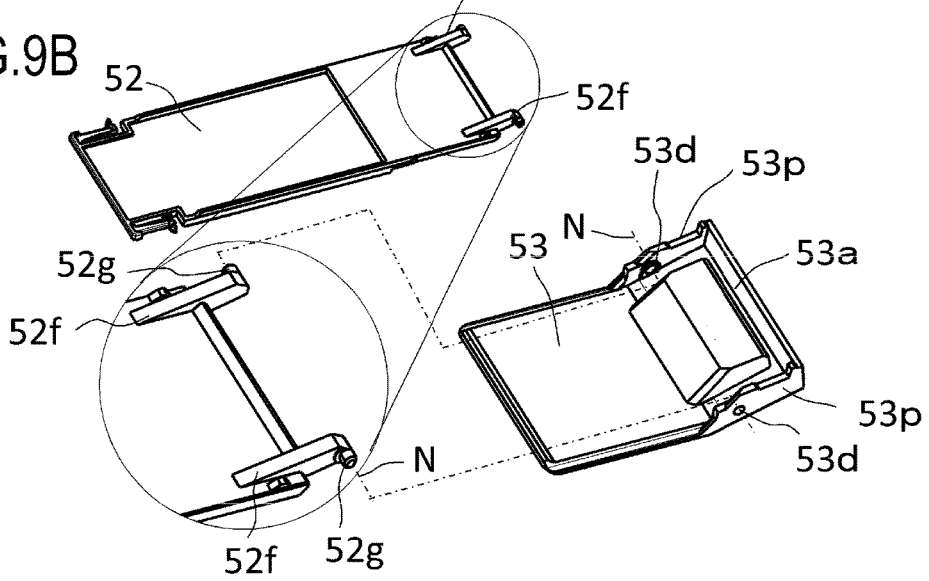
Figure 9C:
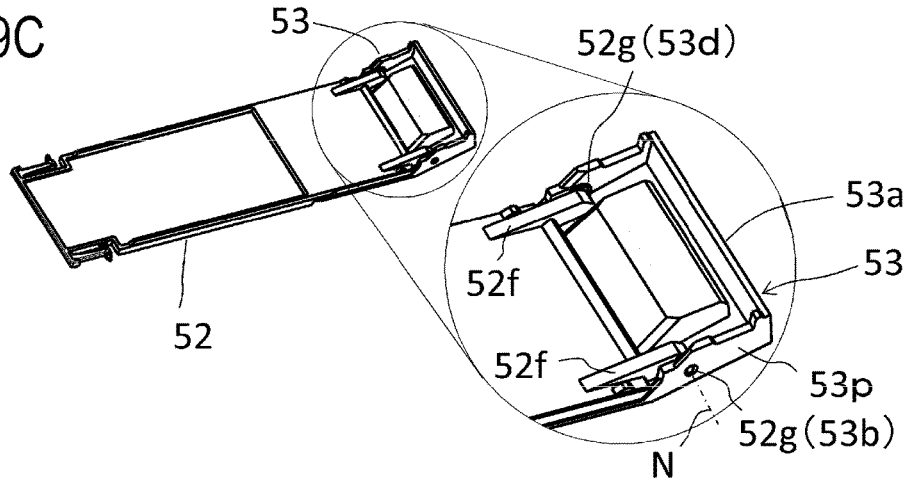

FIG. 9A is an exploded side view of the extension tray 52 and the extension stopper 53, FIG. 9B is an exploded perspective view of the extension tray 52 and the extension stopper 53 taken from below, FIG. 9C is an exploded perspective view of the assembled state of the extension tray 52 and the extension stopper 53 with its partially enlarged view.

As shown in FIG. 9A, the extension tray 52 has the sheet stacking surface 52*a* which is a sheet stacking surface exposed when the extension tray 52 is pulled out from the tray main body 51. Further, a pair of the support arms 52*f* is provided as support portions extending downward from the sheet stacking surface 52*a* at the front end portion of the extension tray 52, and the extension stopper 53 is supported rotatably with respect to the support arms 52*f*. Thus, a rotation shaft 52*g* is provided on the support arms 52*f*, and a rotation center hole 53*d* is provided in each side surface of the extension stopper 53. As shown in FIG. 9B, the rotation shaft 52*g* and the rotation center holes 53*d* of the extension stopper 53 are engaged with each other. The rotation center holes 53*d* are provided in a pair of side walls 53*p* of the handle 53*a*. The side wall 53*p* is provided so as to sandwich the support arms 52*f* from the outside, and the outwardly protruding rotation shaft 52*g* is inserted into the rotation center holes 53*d*.

Accordingly, as shown in FIG. 9C, the extension stopper 53 is rotatably supported with respect to the extension tray 52 around the rotation shaft 52*g* (rotation center holes 53*d*). In the state shown in the figure, the extension stopper 53 is in a closed state reversed with respect to the extension tray 52, the sheet stacking surface 53*b* of the extension stopper 53 is folded rearward so as to face and overlap the sheet stacking surface 52*a* of the extension tray 52, and the handle 53*a* extends forward with respect to the rotation center holes 53*d*. Since the finger placement recess 53*a*1 of the handle 53*a* has a concave shape on the upper surface side, the lower surface side has a convex shape.

In the configuration of this embodiment, the rotation shaft 52*g* of the extension tray 52 and the rotation center holes 53*d* of the extension stopper 53 are engaged with each other. However, a configuration in which the extension tray 52 side is a hole and the extension stopper 53 side is a shaft may also be used. Further, the support arms 52*f* of the extension tray 52 are configured to be housed in the extension stopper 53, but a configuration in which the support arms 52*f* are located outside the extension stopper 53, and the rotation shaft 52*g* is located inside thereof may also be used. Further, in order to constitute the handle 53*a* of a concave shape, two support arms 52*f* are provided, but the support arm 52*f* may be configured of one member by making the handle 53*a* of a convex shape.

Next, positioning regulation of the extension stopper 53 in the width direction will be described with reference to FIGS. 10 and 11.

Figure 10A:
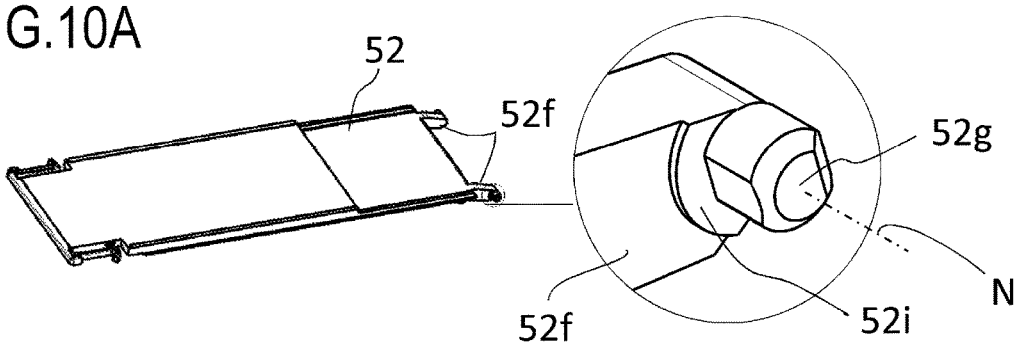
FIG. 10A is a perspective view of the extension tray with its partially enlarged view.
Figure 10B:
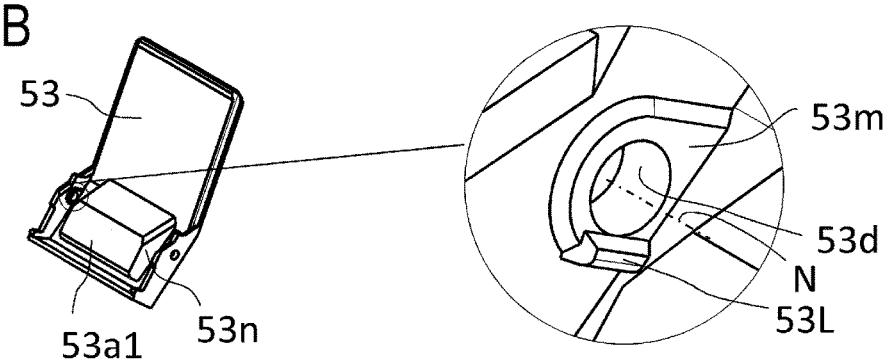
FIG. 10B is a perspective view of the extension stopper with its partially enlarged view.
Figure 10C:
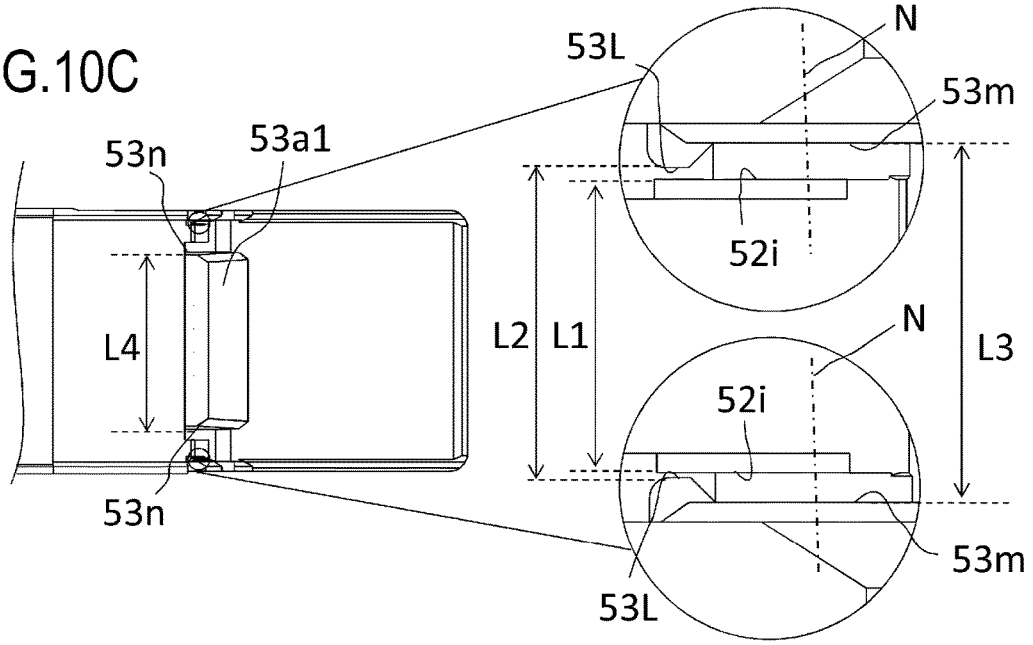
FIG. 10C is a partial top view of the assembled state with its partially enlarged view.
Figure 11A:
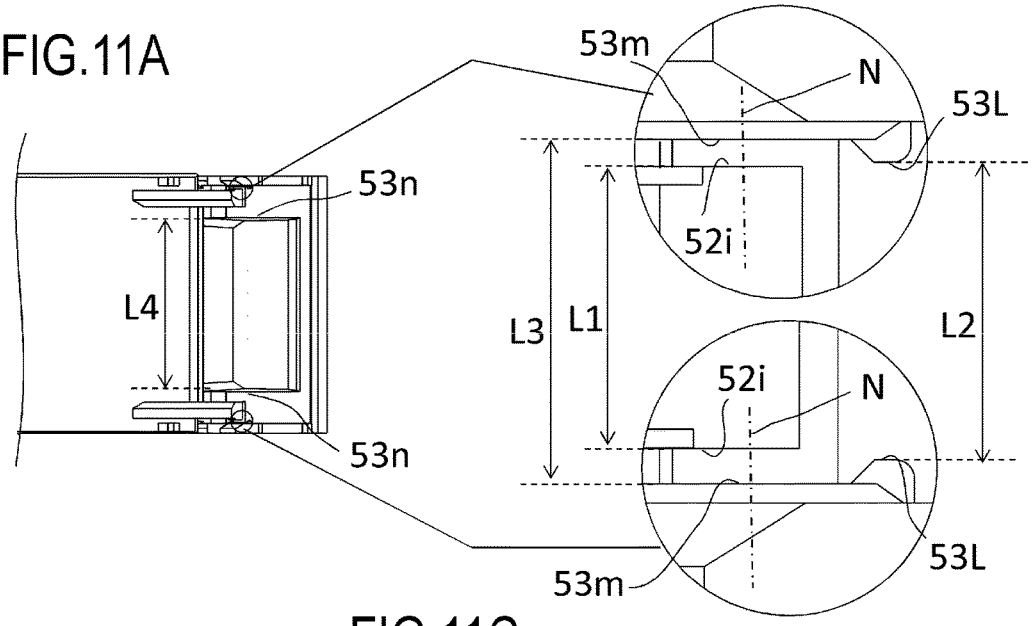
FIG. 11A is a bottom view of the extension stopper in a closed state with its partially enlarged view.
Figure 11B:
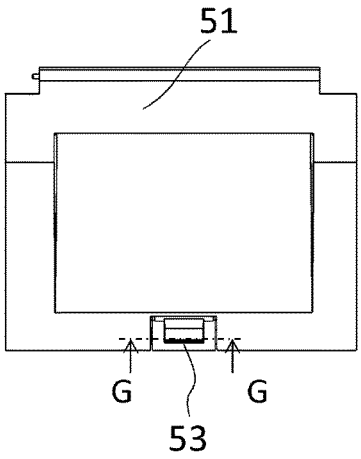
FIG. 11B is a top view of the paper output tray.
Figure 11C:
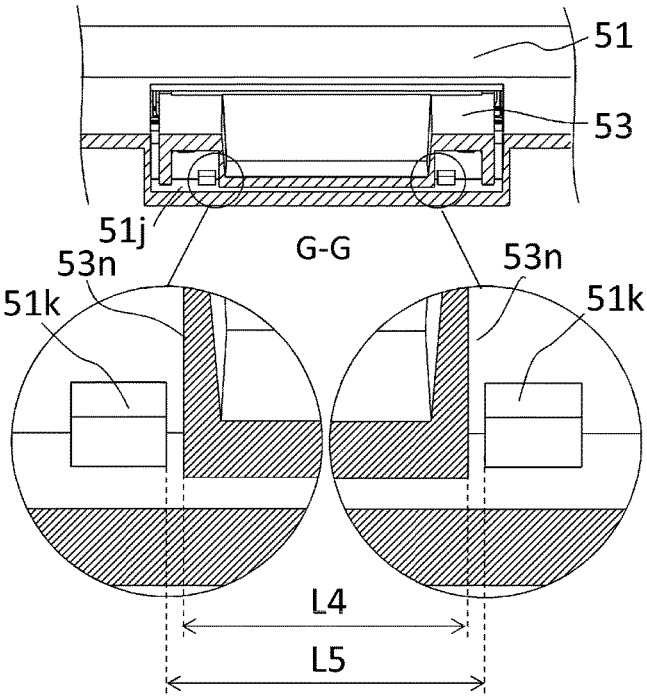
FIG. 11C is an enlarged sectional view taken along the line G-G in FIG. 11B with its partially enlarged view.

FIG. 10A is a perspective view of the extension tray 52 with its partially enlarged view, FIG. 10B is a perspective view of the extension stopper 53 with its partially enlarged view, FIG. 10C is a top view of the extension tray 52 and the extension stopper 53 in the open state with its partially enlarged view. FIG. 11A is a bottom view of the extension tray 52 and the extension stopper 53 in the closed state with its partially enlarged view, FIG. 11B is a top view of the tray main body 51 and the extension stopper 53 in the housing state, FIG. 11C is an enlarged sectional view taken along the line G-G in FIG. 11B with its partially enlarged view.

As shown in FIG. 10A, a tray abutment surface 52*i* as a regulating surface orthogonal to the rotation center line N is provided at each distal end of the support arm 52*f* of the extension tray 52 in the vicinity of the rotation shaft 52*g* which is close to the rotation center line. Here, the distance between the tray abutment surfaces 52*i* on both sides is defined as L1 (see FIG. 10C). Meanwhile, as shown in FIG. 10B, a first abutment surface 53L and a second abutment surface 53*m*, which face the tray abutment surface 52*i*, are provided in the vicinity of the rotation center hole 53*d* near the rotation center line of the extension stopper 53. The first abutment surface 53L and the second abutment surface 53*m* are provided so as to have different phases in the circumferential direction around the rotation center line N as the center.

Further, as shown in FIG. 10C, a third abutment surface 53*n* is provided on both side surfaces on the back side of the finger placement recess 53*a*1 of the handle 53*a*. Here, the distance between the first abutment surfaces 53L on both sides is taken as L2, the distance between the second abutment surfaces 53*m* is taken as L3, and the distance between both side surfaces of the third abutment surface 53*n* is taken as L4 (FIG. 10).

In the open state of the extension stopper 53, the first abutment surface 53L and the second abutment surface 53*m* of the extension stopper 53 are close to the tray abutment surface 52*i* of the extension tray 52. Since the dimensional relationship in the width direction of the apparatus main body 2 is L2<L3, the first abutment surface 53L abuts against the tray abutment surface 52*i*. As a result, in the open state, the position of the extension stopper 53 with respect to the extension tray 52 in the width direction (direction parallel to the rotation center line N) is regulated by the first abutment surface 53L and the tray abutment surface 52*i*.

Meanwhile, in the closed state of the extension stopper 53, as shown in FIG. 11A, the first abutment surface 53L separates from the tray abutment surface 52*i* of the extension tray 52, and the second abutment surface 53*m* is close to the tray abutment surface 52*i*. Therefore, in the closed state of the extension stopper 53, the second abutment surface 53*m* abuts against the tray abutment surface 52*i*. As a result, in the closed state, the position of the extension stopper 53 with respect to the extension tray 52 in the width direction (direction parallel to the rotation center line N) is regulated by the second abutment surface 53*m* and the tray abutment surface 52*i*.

Further, in a state in which the extension stopper 53 is housed in the tray main body 51, as shown in FIGS. 11B and 11C, the third abutment surface 53*n* of the extension stopper 53 is close to the front protruding portions 51*k* of the tray main body 51.

Thus, the front protruding portions 51*k* position the light shielding sheet 54 as described above and also function as protruding portions for regulation in the width direction. Meanwhile, the side surface on the back side of the finger placement recess 53*a*1 of the extension stopper 53 becomes the third abutment surface 53*n* and faces the front protruding portions 51*k* through a predetermined gap in the direction parallel to the rotation center line N.

Here, where the distance in the width direction between the front protruding portions 51*k* is taken as L5, the extension stopper 53 is close to other parts at two locations of L1-L3 and L4-L5 when the extension stopper 53 is housed. Where the gaps at two locations are compared, since the relationship of (L5-L4)<(L3-L1) is satisfied, the third abutment surface 53*n* is regulated in the direction parallel to the rotation center line by the front protruding portions 51*k* of the tray main body 51. Therefore, when the extension stopper 53 is housed, the position of the extension stopper 53 in the width direction of the apparatus main body 2 is regulated with respect to the tray main body 51.

As described above, the position of the extension stopper 53 with respect to the width direction of the apparatus main body 2 is regulated by different parts in the opened/closed state and pulled-out/housing state. By determining optimum positioning parts in each state, it is possible to reduce gaps and rattles between parts in each state, and it is also possible to maintain an excellent appearance.

(Support Configuration in Rotation Direction of Extension Stopper 53)

Figure 12A:
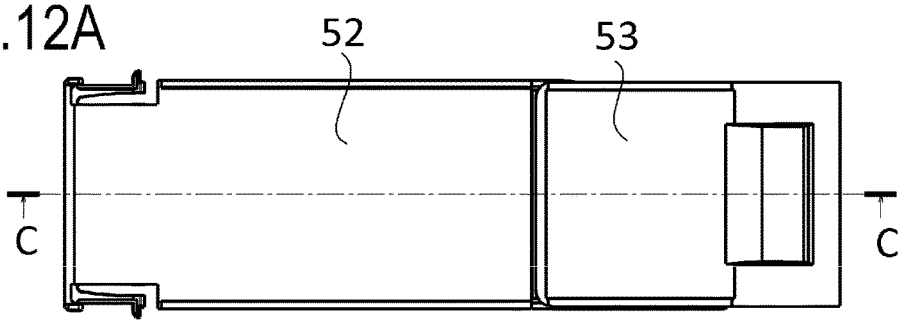
FIGS. 12A to 12D show the assembled states of the extension tray and extension stopper.
Figure 12B:
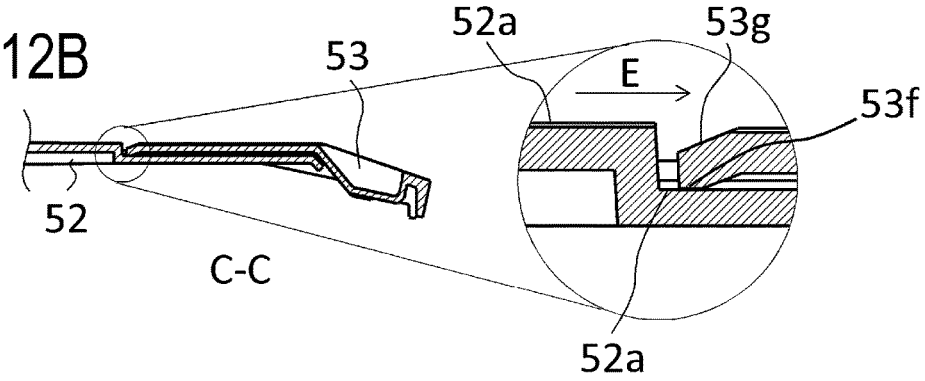
Figure 12C:
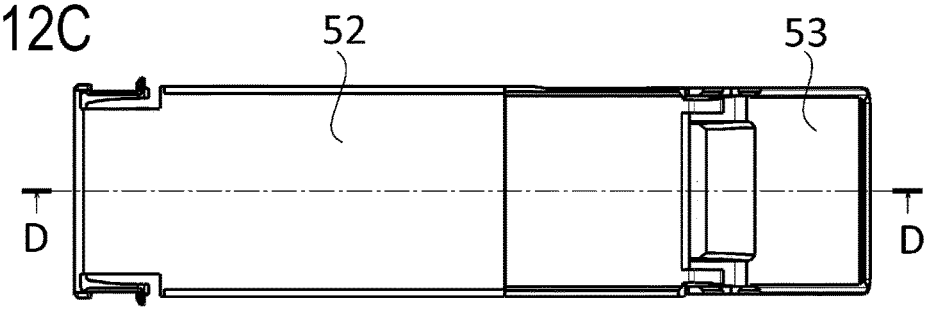
Figure 12D:
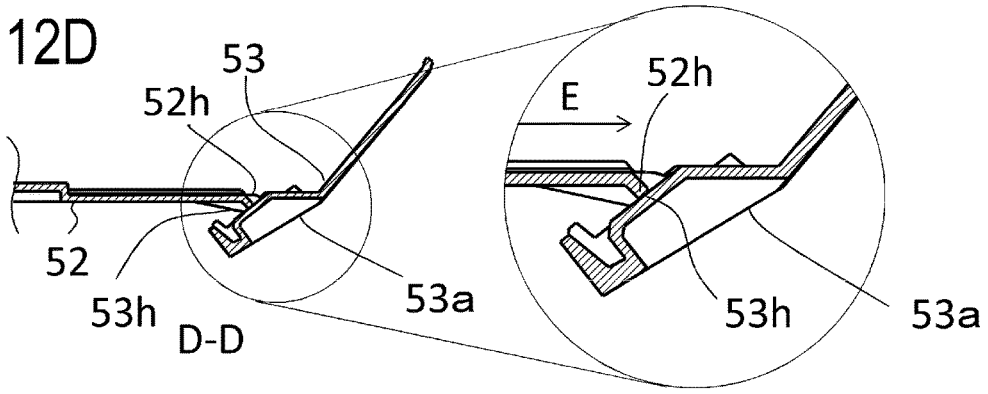

Next, a support configuration in the rotation direction in the open-closed state of the extension stopper 53 will be described with reference to FIGS. 12A to 12D. FIG. 12A is a top view of the extension stopper 53 in the closed state. FIG. 12B is a partial cross-sectional view taken along the line C-C in FIG. 12A with its partially enlarged view. FIG. 12C is a top view of the extension stopper 53 in the open state. FIG. 12D is a partial cross-sectional view taken along the line D-D in FIG. 12C with its partially enlarged view. In the cross-sectional view, the rear portion of the extension tray 52 is omitted.

In the closed state (folded and housing state) of the extension stopper 53, as shown in the enlarged view of FIG. 12B, the distal end portion 53*f* of the extension stopper 53 abuts against the sheet stacking surface 52*a* on the lower stage side of the extension tray 52. The position of the extension stopper 53 in the rotation direction is determined by the abutment of the distal end portion 53*f*.

Further, the distal end upper portion 53*g*, which is the upper surface of the distal end portion 53*f* of the extension stopper 53 in this housing state, is an inclined surface with a distal end inclined downward toward the rear side. In the closed state of the extension stopper 53, the leading end of the sheet S is prevented from being caught between the extension tray 52 and the extension stopper 53 even when the sheet S is discharged in the direction of arrow E.

Further, as shown in FIGS. 12C and 12D, in the open state of the extension stopper 53, a rotation support surface 53*h* provided at the extension stopper 53 abuts against the rotation support protrusion 52*h* provided at the distal end portion of the extension tray 52. The rotation support surface 53*h* is the back surface of the finger placement recess 53*a*1 of the handle 53*a*. When the rotation support surface 53*h* is abutted, the moment in the rotation direction (opening direction) due to the weight of the extension stopper 53 is supported, and the opening angle of the extension stopper 53 is determined. Further, the rotation support surface 53*h* of the extension stopper 53 is an inclined surface facing obliquely downward toward the extension tray 52 in the open state. Therefore, when the sheet S is discharged in the direction of the arrow E in the open state of the extension stopper 53, the leading end of the sheet S is prevented from being caught between the extension tray 52 and the extension stopper 53.

(Extension Tray Housing and Paper Sheet Output)

Next, the relationship between the housing state of the extension stopper 53 and paper sheet output will be described with reference to FIGS. 13 and 14.

Figure 13A:
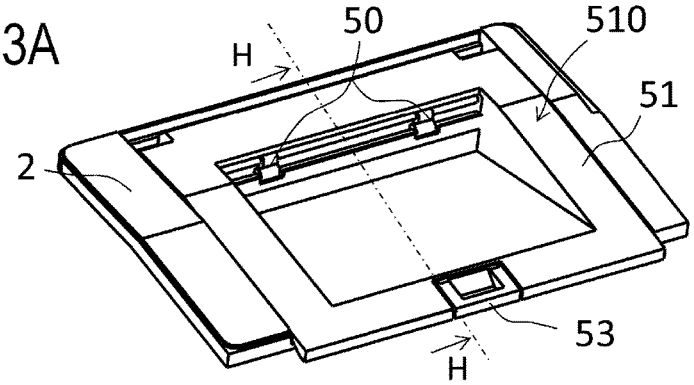
FIG. 13A is a schematic perspective view of the paper output tray in a regular housing state.
Figure 13B:
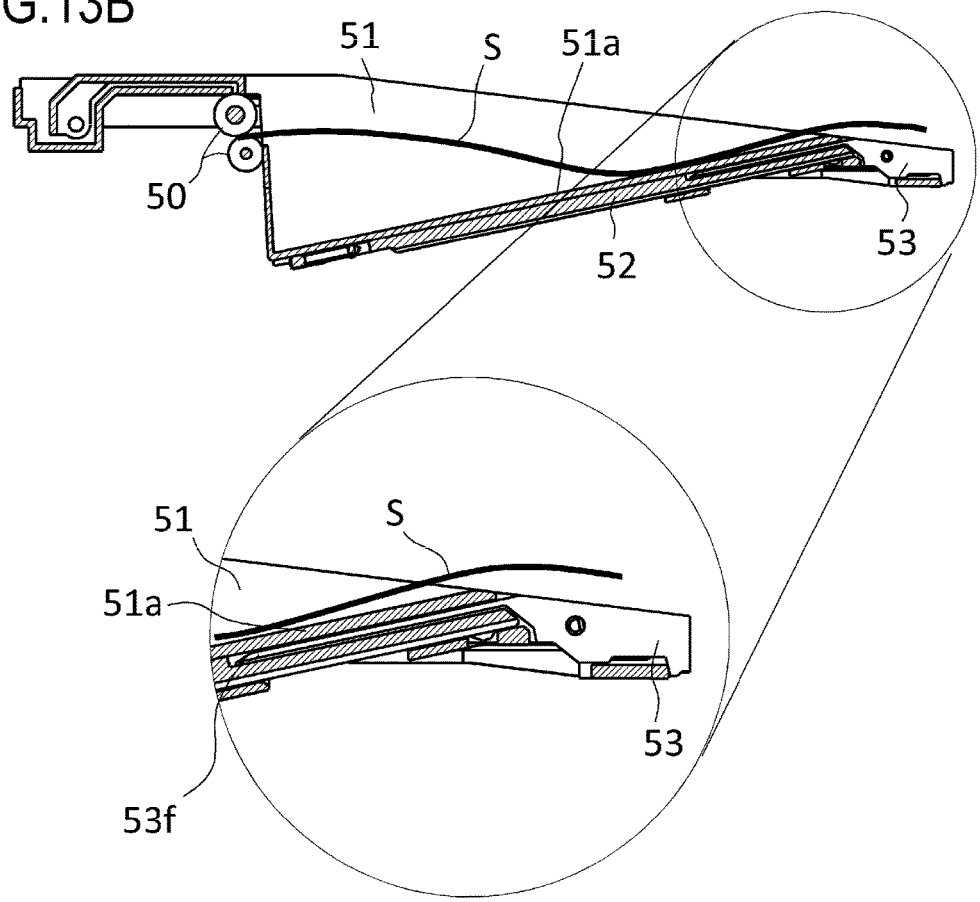
FIG. 13B is an enlarged sectional view taken along the line H-H in FIG. 13A with its partially enlarged view.

First, paper sheet output when the extension stopper 53 is properly housed will be explained with reference to FIG. 13. FIG. 13A is a perspective view of the apparatus main body 2 as viewed obliquely from the top, FIG. 13B is a sectional view taken along the line H-H in FIG. 13A with its partially enlarged view.

As shown in the drawings, when the extension stopper 53 is properly housed, the distal end portion 53*f* of the extension stopper 53 enters below the sheet stacking surface 51*a* and is housed inside the tray main body 51. Because of such housing, the sheet S can be discharged so that the leading end of the sheet S is not caught even in the closed state of the extension tray 52.

(Flow of Paper Sheet Output at the Time of Irregular Housing)

Figure 14A:
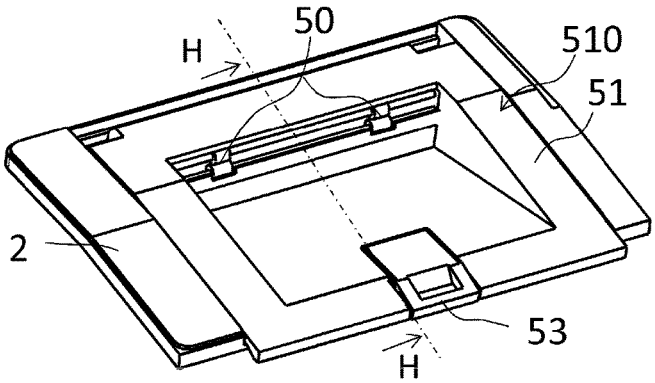
FIG. 14A is a schematic perspective view of the paper output tray in an irregular housing state.
Figure 14B:
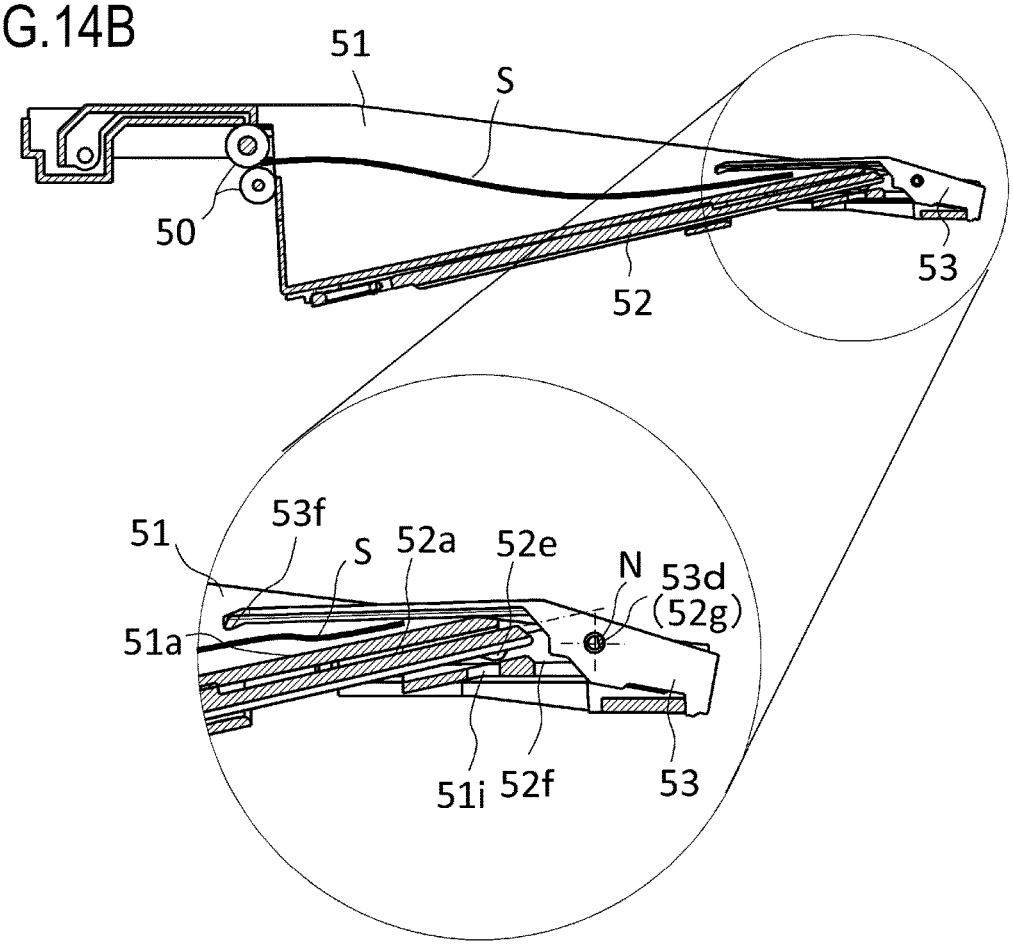
FIG. 14B is an enlarged sectional view taken along the line H-H in FIG. 14A with its partially enlarged view.

Next, the paper sheet output in an irregular housing state in which the extension stopper 53 is incorrectly housed will be explained with reference to FIG. 14. FIG. 14A is a perspective view of the apparatus main body 2 taken obliquely from above, FIG. 14B is a cross-sectional view taken along the line H-H in FIG. 14A with its partially enlarged view.

In the irregular housing state, the extension stopper 53 is folded in a state of protruding to the upper surface side of the tray main body 51 when the extension tray 52 is housed in the tray main body 51. In this state, as shown in the enlarged view of FIG. 14B, since the distal end portion 53*f* is located on the upper side of the sheet stacking surface 51*a*, the leading end of the discharged sheet S is caught between the extension stopper 53 and the sheet stacking surface 51*a*. In the case where a load is applied in the pull-out direction of the extension tray 52 in a state in which the sheet S is caught, the extension tray 52 cannot be pushed out by the pushing force of the paper output roller pair 50 and the sheet S, and the sheet S is not completely discharged. When the sheet S is not discharged, a sheet jam occurs and the printing operation is interrupted. The resulting disadvantage is that the user is caused to interrupt printing or to perform sheet jam processing.

However, according to the present invention, in the case of an irregular housing state, the extension tray 52 cannot be pushed all the way to the end, and the protruding portion 52*e* located at the front end of the side surface portion 52*b* of the extension tray 52 and the hole portion 51*i* provided in the tray guide 51*e* are not engaged with each other. Thus, in the irregular housing state, the positional relationship is set such that the protruding portion 52*e* does not engage with the hole portion 51*i*. Since the extension tray 52 cannot be pushed all the way to the end, the load in the pull-out direction generated when the protruding portion 52*e* rides on the tray guide 51*e* disappears, so that the pushing force acting on the sheet S from the paper output roller pair 50 can push out the extension tray 52 and the extension stopper 53.

Further, since the extension stopper 53 is rotatably supported on the support arms 52*f* extending downward from the sheet stacking surface 52*a* of the extension tray 52, the rotation center line N is located below the extension line of the sheet stacking surface 52*a* of the extension tray 52. Therefore, when the leading end of the sheet S abuts against the extension stopper 53 under the effect of the paper output roller pair 50, a moment in the direction of rotating the extension stopper 53 to the open state is generated around the rotation center line N by the pushing force of the sheet S. By this moment, the extension stopper 53 rotates forward and expands to the open state.

Next, the expansion process of the extension stopper 53 will be described in detail with reference to FIGS. 15A to 15H.

FIGS. 15A to 15H show a partial cross-sectional view taken along the H-H line in FIG. 14A described hereinabove and a partial enlarged view thereof, those views illustrating a process in which the extension tray 52 and the extension stopper 53 are pushed out by the sheet S. Further, in FIGS. 15A to 15H, the rear part of the tray main body 51 and parts below the tray main body 51 are omitted.

The extension stopper 53 includes a plurality of push-out portions that abuts against the leading end of the sheet S discharged to the tray main body 51 in an irregular housing state. In the example shown in the figure, a first inclined surface 53*j* and a second inclined surface 53*k* serve as two adjacent push-out portions of one set. Of these, the second inclined surface 53*k* is closer to the rotation center line N than the first inclined surface 53*j*, and the leading end of the sheet S sequentially comes into contact with the sheet stacking surface 53*b*, the first inclined surface 53*j*, and the second inclined surface 53*k*.

The first inclined surface 53*j* is configured of the obliquely extending edge of a side wall 53*p* where the rotation center hole 53*d* of the extension stopper 53 is formed, and an inclined surface protrusion 53*i* that further projects partially in a triangular shape is provided at the edge of the side wall 53*p*. One side of the inclined surface protrusion 53*i* on the first inclined surface 53*j* side constitutes the second inclined surface 53*k*.

Figure 15A:
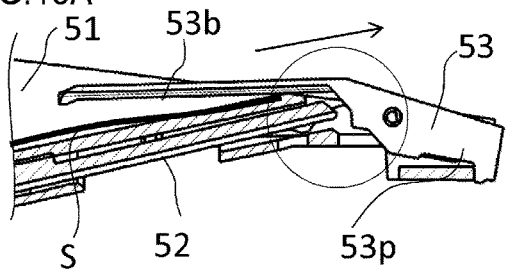
FIGS. 15A to 15H are explanatory drawings illustrating the operation of paper sheet output in the irregular housing state.
Figure 15B:
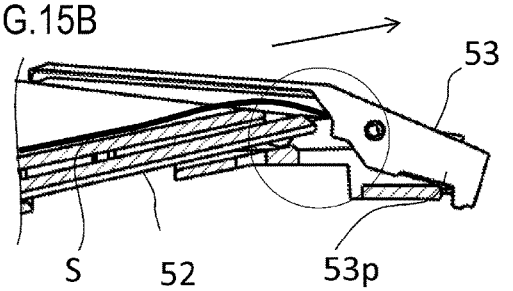
Figure 15C:
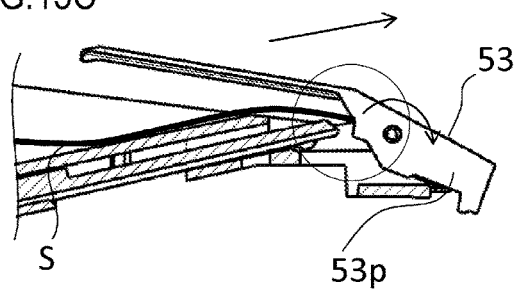
Figure 15D:
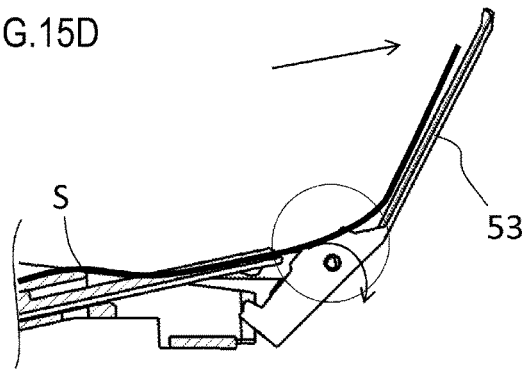
Figure 15E:
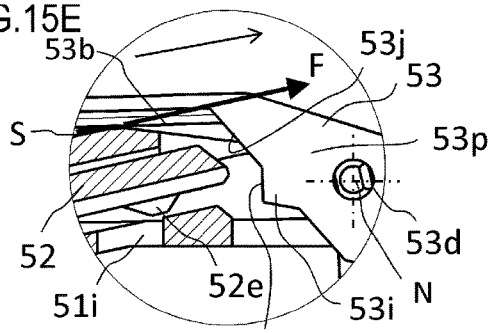
Figure 15F:
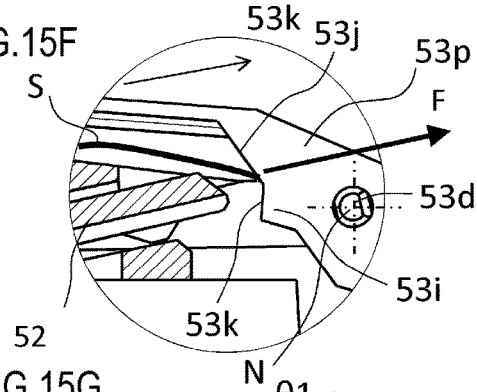

Thus, as shown in FIGS. 15A and 15E, the push-out of the extension tray 52 is started when the leading end of the sheet S pushes the sheet stacking surface 53*b* of the extension stopper 53. Here, F in the figure represents the push-out force created by the paper output roller pair 50 and the sheet S. As shown in FIGS. 15B and 15F, where the extension tray 52 is pushed out, the leading end of the sheet S pushes out the first inclined surface 53*j* of the extension stopper 53.

Figure 15G:
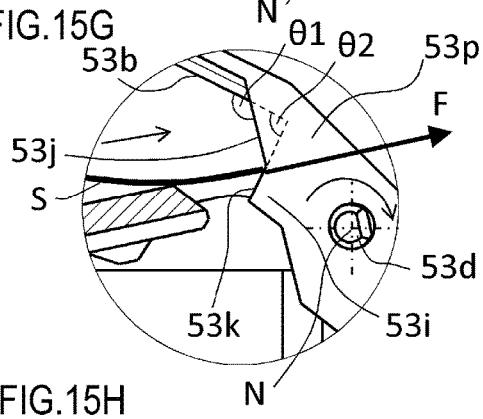

In FIGS. 15C and 15G, the angle θ1 between the first inclined surface 53*j* of the extension stopper 53 and the sheet stacking surface 53*b* is greater than the angle θ2 between the second inclined surface 53*k*, which is the second push-out portion on the rotation center side of the extension stopper 53, and the sheet stacking surface 53*b* (θ1>θ2). In the present embodiment, θ1=130° and θ2=90°.

Figure 15H:
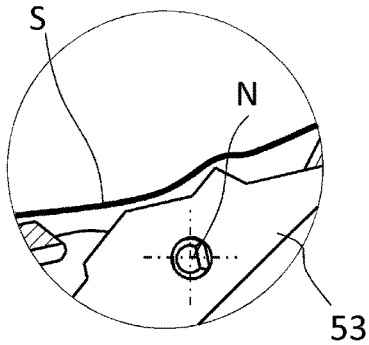

Because of the relationship of θ1>θ2, where the sheet S is output, the sheet comes into contact with the inclined surface protrusion 53*i* of the extension stopper 53, so that the leading end of the sheet S is held between the first inclined surface 53*j* and the second inclined surface 53*k*. In a state where the leading end of the sheet S is thus held, the push-out force F is applied to the first inclined surface 53*j*. Here, since the rotation center hole 53*d*, which is the rotation center of the extension stopper 53, is located below the sheet S, the push-out force F by the sheet S generates a moment for rotating the extension stopper 53. Due to this moment, the extension stopper 53 rotates forward. Further, as shown in FIGS. 15D and 15H, when the extension stopper 53 is completely opened, the sheet S is discharged. The extension tray 52 is not completely pulled out, but because the leading end of the sheet S is not caught, the sheet S is completely discharged and sheet jamming can be prevented.

In the above-described embodiment, the extension stopper 53 is configured to have the first inclined surface 53*j* and the second inclined surface 53*k* as two push-out portions, but three or more push-out portions may be provided. In that case, the angular relationship with respect to the sheet stacking surface 53*b* may be the abovementioned relationship with respect to two adjacent push-out portions of one set from the three or more push-out portions.

Other Embodiments

In the present embodiment, a monochrome image forming apparatus having one photosensitive drum has been described. However, the present invention is not limited to such an apparatus, and can be also applied to a color image forming apparatus of a tandem system having a plurality of photosensitive drums, or a color image forming apparatus of a rotary system having one photosensitive drum. Further, the present invention can also be applied to an image forming apparatus using a transfer material carrying belt that carries and conveys a transfer material.

According to the present invention, a sheet can be discharged without the occurrence of sheet jamming even when the first extension tray of the pull-out system is housed in the tray main body in a state in which the second extension tray of the rotation system appears outside the tray main body.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-144768, filed Jul. 22, 2016 which is hereby incorporated by reference herein in its entirety.

What is claimed is:

1. A paper output tray holding sheets, which are discharged, the paper output tray comprising:

a tray main body having an upper surface and a lower surface side opposite to the upper surface, the upper surface being a sheet holding surface;

a first extension tray configured to be (i) housed on the lower surface side of the tray main body and (ii) pulled out from the tray main body in a sheet discharge direction; and a second extension tray which is rotatably supported by the first extension tray and which is rotatable to be in a closed state in which the second extension tray is folded with respect to the first extension tray and an open state in which the second extension tray is open with respect to the first extension tray so that a sheet holding region is wider than that in the closed state, wherein, in a case where the second extension tray is located above the upper surface of the tray main body and the first extension tray is housed in the tray main body on the lower surface side thereof, the second extension tray is configured to move toward the open state when a discharged sheet contacts the second extension tray.

2. The paper output tray according to claim 1, wherein the second extension tray includes a plurality of push-out portions against which a leading end of the discharged sheet abuts in a state in which the first extension tray is housed in the tray main body and the second extension tray is folded on the upper surface side of the tray main body, a first push-out portion of the plurality of push-out portions being (i) adjacent to a second push-out portion of the plurality of push-out portions and (ii) located at a position farther from a rotation center line of the second extension than the second push-out portion, an angle θ1 formed between the first push-out and the sheet holding surface of the second extension tray is set to be larger than an angle θ2 formed between the second push-out portion and the sheet holding surface of the second extension tray.

3. The paper output tray according to claim 1, further comprising a guide portion with which a guided portion of the first extension tray slidably engages, the guide portion being provided on a lower surface of the tray main body, the guided portion of the first extension tray including an engaging convex portion, the guiding portion of the tray main body including an engaging concave portion, the engaging convex portion and the engaging concave portion being engageable with each other, wherein in a state in which the first extension tray is housed in the tray main body and the second extension tray is folded on the upper surface side of the tray main body, the engaging convex portion and the engaging concave portion are set to a positional relationship where the engaging convex portion and the engaging concave portion are not engaged with each other.

4. The paper output tray according to claim 1, wherein the tray main body is provided with an insertion port for housing the first extension tray and also provided with a light shielding sheet for shielding a gap between an edge of the insertion port and the first extension tray.

5. The paper output tray according to claim 1, wherein:

a support portion of the first extension tray which rotatably supports the second extension tray is provided with a regulation surface orthogonal to a rotation center line of the second extension tray in the vicinity of the rotation center line, the second extension tray includes a first abutment surface and a second abutment surface, which face the regulation surface, provided so as to have different phases in a circumferential direction around the rotation center, and in the open state of the extension tray, the position of the first abutment surface in a direction parallel to the rotation center line is regulated by the regulation surface, and in the closed state of the second extension tray, the position of the second abutment surface in a direction parallel to the rotation center line is regulated by the regulation surface.

6. The paper output tray according to claim 5, wherein:

the tray main body is provided with a protruding portion for regulation;

the second extension tray is provided with a third abutment surface which faces the protruding portion for regulation via a predetermined gap in a direction parallel to the rotation center line in a housing state in which the first extension tray is housed in the tray main body, with the second extension tray being in the closed state; and in the housing state, the position of the second extension tray with respect to the tray main body in the direction parallel to the rotation center line is regulated by the third abutment surface and the protruding portion for regulation.

7. The paper output tray according to claim 1, wherein in the open state of the second extension tray, a rotation support surface provided on the second extension tray abuts against a distal end portion of the first extension tray.

8. The paper output tray according to claim 1, wherein:

the second extension tray includes a front receiving portion, the front receiving portion protruding so as to face a front end portion of the tray main body at a front end of the second extension tray in a closed state with respect to the first extension tray, and when the first extension tray is housed, the front receiving portion of the second extension tray abuts against the front end portion of the tray main body, thereby positioning the housing position of the first extension tray.

9. An image forming apparatus comprising:

an apparatus main body; and the paper output tray according to claim 1.

10. The image forming apparatus according to claim 9, wherein the paper output tray also functions as a door for opening and closing an opening portion provided in an upper portion of the apparatus main body.

11. The paper output tray according to claim 1, wherein a rotational axis of the second extension tray is located below a virtual surface obtained by extending the upper surface of the tray main body.

12. A paper output tray holding sheets, which are discharged, the paper output tray comprising:

a tray main body having an upper surface and a lower surface side opposite to the upper surface, the upper surface being a sheet holding surface;

a first extension tray configured to be (i) housed on the lower surface side of the tray main body and (ii) pulled out from the tray main body in a sheet discharge direction; and a second extension tray which is rotatably supported by the first extension tray and which is rotatable to be in a closed state in which the second extension tray is folded with respect to the first extension tray and an open state in which the second extension tray is open with respect to the first extension tray so that a sheet holding region is wider than that in the closed state, wherein the first extension tray has a support portion extending downward from a virtual surface obtained by extending the upper surface, the second extension tray is rotatably supported by the support portion, and a rotational axis of the second extension tray is located below the virtual surface obtained by extending the upper surface of the tray main body.

* * * * *